US007336239B2

(12) United States Patent
Takei

(10) Patent No.: US 7,336,239 B2
(45) Date of Patent: Feb. 26, 2008

(54) SMALL MULTI-MODE ANTENNA AND RF MODULE USING THE SAME

(75) Inventor: Ken Takei, Kawasaki (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/525,378

(22) PCT Filed: Oct. 15, 2002

(86) PCT No.: PCT/JP02/10608

§ 371 (c)(1),
(2), (4) Date: Jul. 12, 2006

(87) PCT Pub. No.: WO2004/036687

PCT Pub. Date: Apr. 29, 2004

(65) Prior Publication Data

US 2006/0262028 A1 Nov. 23, 2006

(51) Int. Cl.
*H01Q 1/50* (2006.01)

(52) U.S. Cl. ..... 343/850; 343/851; 343/858

(58) Field of Classification Search ..... 343/702, 343/850, 895, 722, 749, 851, 858, 860
See application file for complete search history.

(56) References Cited

U.S. PATENT DOCUMENTS 2,096,782 A 10/1937 Brown et al.
4,085,405 A * 4/1978 Barlow ..... 343/858
4,145,693 A * 3/1979 Fenwick ..... 343/722
4,217,589 A * 8/1980 Stahler ..... 343/722
4,494,122 A 1/1985 Garay et al.
5,963,170 A 10/1999 Garner et al.
6,025,813 A * 2/2000 Hately et al. ..... 343/867

(Continued)

FOREIGN PATENT DOCUMENTS

EP 0 650 215 A2 9/1994

(Continued)

OTHER PUBLICATIONS

James, Jr, et al."Handbook of Microstrip Antennas", Peter Peregrinus Ltd., 1989, p. 1144.

(Continued)

*Primary Examiner*—Tho Phan
(74) *Attorney, Agent, or Firm*—Reed Smith LLP; Stanley P. Fisher, Esq.; Juan Carlos A. Marquez, Esq.

(57) ABSTRACT

A small multi-mode antenna in which a single feeding point can be used commonly for multiple frequencies and an RF module using such antenna for use in less-costly and small multimedia wireless apparatus is provided. The antenna is configured such that a single feeding point 4 which is common for multiple frequencies is set up at one end of a radiating conductor 1, a first one-port resonant circuit 2 is connected to the one end thereof, and a second one-port resonant circuit 3 is connected to the other end of the radiating conductor 1. With a conductance component of admittance in view from the feeding point 4 toward free space equaling the characteristic admittance in the RF circuit, a susceptance component of the admittance is canceled out by the resonant circuit 2 connected to the feeding point 4 for multiple frequencies.

15 Claims, 23 Drawing Sheets

U.S. PATENT DOCUMENTS

| | | | | |
|---|---|---|---|---|
| 6,028,554 | A | 2/2000 | Mandai et al. | |
| 6,097,342 | A * | 8/2000 | Engblom | 343/702 |
| 2005/0012674 | A1 | 1/2005 | Takei | |

FOREIGN PATENT DOCUMENTS

| | | |
|---|---|---|
| EP | 0 863 571 A2 | 3/1998 |
| JP | S60-182203 | 2/1984 |
| JP | 61-265905 | 5/1985 |
| JP | 01-158805 | 12/1987 |
| JP | H03-113516 | 3/1990 |
| JP | H04-233303 | 12/1990 |
| JP | 2002-300081 | 3/2001 |
| JP | 2005-39394 | 7/2003 |

OTHER PUBLICATIONS

Rohde, U., et al. "RF/Microwave Circuit Design for Wireless Application", John Wiley & Sons, 2000, pp. 63-64.

James, J. et al "Handbook of microstrip antennas. vols. 1&2",IEE-Peter Peregrinus, Ltd., 1989.

Ulrich, R., et al. "RF/Microwave Circuit Design for Wireless Applications", John Wiley & Sons, Apr. 2000.

JPO Notification of Reasons for Refusal for JP2004-544697 dated Jul. 10, 2007, in English and Japanese.

Chinese Patent Office First Office Action for CN Appl. 02829522.6, dated Jun. 8, 2007, in English and Chinese.

* cited by examiner

FIG. 10A1
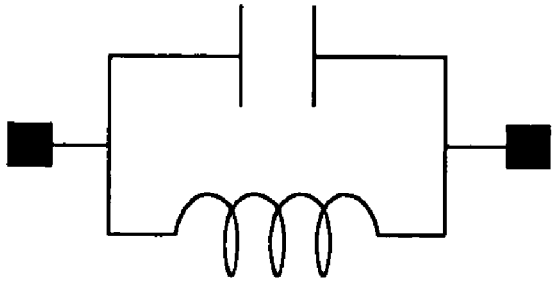
FIG. 10A2
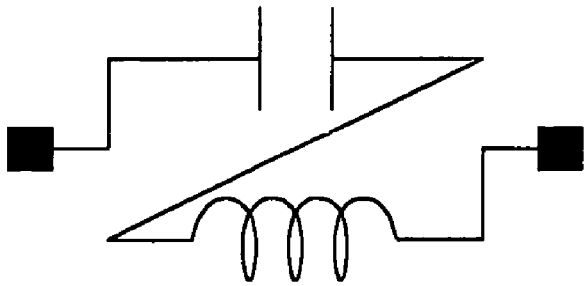

FIG. 10B1
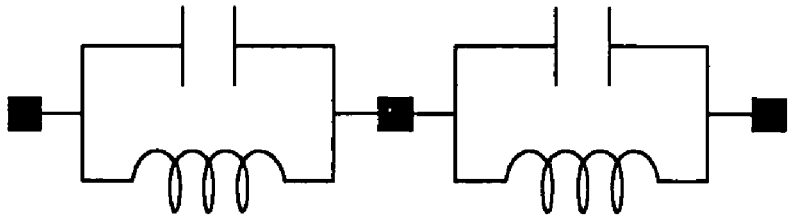
FIG. 10B2
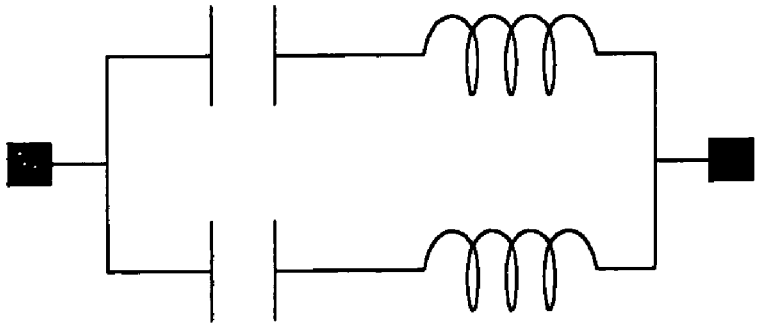

SMALL MULTI-MODE ANTENNA AND RF MODULE USING THE SAME

This application is a 371 of PCT/JP02/10608 filed on Oct. 15, 2002.

TECHNICAL FIELD

The present invention relates to an antenna of wireless apparatus that provides the user with multi-media services and a RF (Radio Frequency) module including the antenna. In particular, for use in multimedia wireless apparatus that implements a plurality of services by information transmission through the media of electromagnetic waves with different frequencies, the invention relates to a multi-mode antenna applied to the wireless apparatus and a multi-mode compatible RF module including the antenna.

BACKGROUND ART

Multimedia services providing services in terms of transferring and providing various kinds of information by way of radio transmission are getting more active lately and a great number of wireless apparatuses have been developed and put into practical use. These services are diversified year after year, involving telephones, TVs, Local Area Networks (LANs). etc. End users are required to have different wireless apparatuses for different services to receive all services.

With the aim of improving the usability of end users who receive such services, attempts have already started to provide the services to end users anytime and anywhere, namely, in a ubiquitous manner, thus making the presence of media transparent to the users. A single terminal apparatus that implements a plurality of information transfer services, namely, a so-called multi-mode terminal is realized, but partially.

Because a ubiquitous information transmission service by ordinary radio transmission uses electromagnetic waves as its medium, a plurality of services are provided to end users by using several frequencies in a same service area; one frequency for one type of service. Therefore, a multi-media terminal is required to have capability of transmitting and receiving multiple frequencies.

For conventional multimedia terminals, a method in which a plurality of single-mode antennas, each provided for one frequency, are installed on a single wireless apparatus is used. In this method, it is needed to install the antennas separated each other by a distance equivalent to wavelength to make each single-mode antenna operate independently. Because the frequencies of electromagnetic waves that are used for services in terms of normal ubiquitous information transmission are limited to a range from a few hundred MHz to a few GHz due to the limitation of their free space propagation characteristic, the antennas must be separated each other by a distance of a few tens of centimeters to a few meters. Consequently, the dimension of the terminal becomes large and portability for the user is not satisfied. Because the antennas sensitive to different frequencies are arranged, separated each other by a distance, it is needed to install separate RF circuits connecting to the antennas for each frequency.

For this reason, it is difficult to apply semiconductor integration circuit technology and there arises a problem of high-cost RF circuits as well as the increased dimensions of the terminal. Even when the RF circuits are integrated into a whole by applying the integration circuit technology with great efforts, there is a need for connecting the RF circuit to the individual antennas separated by a distance with RF cables. By the way, the diameter of the RF cable applicable to a terminal with dimensions allowing for portability for the user is around one millimeter. Consequently, transmission loss of the RF cable in the current situation reaches a few dB/m. With the use of such RF cable, power consumed by the RF circuit increases. This causes a significant decrease in use duration of the terminal providing ubiquitous information services or a significant increase in the terminal weight due to increased battery volume and poses a problem of significantly degrading the usability for the user of the terminal.

Aside from the foregoing, two-frequency duplex antennas in which one end of a loop antenna or the material of the antennal is connected to a transmitter which transmits at one frequency and the other end is connected to a receiver which receives at the other frequency are disclosed (e.g., Japanese Patent Laid-Open No. S61(1986)-295905 and Japanese Patent Laid-Open No. H1(1989)-158805).

A two-frequency duplex antenna described in Japanese Patent Laid-Open No. S61(1986)-295905 is configured such that first and second resonant circuits respectively connected to either ends of the loop antenna which is a radiating conductor resonate with the loop antenna, wherein one resonator at one terminal resonates at a transmit frequency and the other resonator at the other terminal resonates at a receive frequency, and the transmitter is connected to the one terminal and the receiver is connected to the other terminal.

Another two-frequency duplex antenna described in Japanese Patent Laid-Open No. H1(1989)-158805 is configured such that a first resonant circuit resonating at a transmit frequency, connected between one end of the material of the antenna which is a radiation conductor and a transmit output terminal, assumes a high impedance to a receive frequency and disconnects the material of the antenna from the transmit output terminal, and a second resonant circuit resonating the receiving frequency, connected between the other terminal of the material of the antenna and a receive input terminal, assumes a high impedance to a transmit frequency and disconnects the material of the antenna from the receive input terminal.

Even for a wireless apparatus employing either of these two-frequency duplex antennas, it is needed to provide the transmitter and the receiver for each of input and output terminals (feeding points) located at separate positions for different frequencies. Thus, it is difficult to integrate both, which makes a bottleneck in downsizing the wireless apparatus.

DISCLOSURE OF INVENTION

One of key devices of a multimedia wireless apparatus is a multi-mode antenna sensitive to electromagnetic waves with multiple frequencies. The multi-mode antenna is a single structure that realizes a superior matching characteristic between the characteristic impedance in free space and the characteristic impedance in the RF circuit of the wireless apparatus for electromagnetic waves with multiple frequencies.

If, in such multi-mode antenna, a same feeding point (input-output terminal) can be set up for electromagnetic waves with different frequencies, RF circuits that process multiple frequencies are allowed to share the single feeding point. In consequence, semiconductor integration circuit technology can be applied and, therefore, RF circuit downsizing can be achieved and a small and less costly RF module compatible with multiple frequencies can be realized.

Objects of the present invention are to provide a small multi-mode antenna in which a single feeding point can be used commonly for multiple frequencies in order to realize a less costly and small multimedia wireless apparatus, and to provide a small RF module using the multi-mode antenna.

To achieve the above objects, a multi-mode antenna of the present invention has a structure comprising a radiating conductor which radiates electromagnetic waves with a plurality of frequencies for which the antenna should operate, a first one-port (two-terminal) resonant circuit connected to one end of the radiating conductor, a second one-port resonant circuit connected to the other end of the radiating conductor, and a single feeding point which is common for the plurality of frequencies and connected to the first one-port resonant circuit.

In the multi-mode antenna having such structure, because there is the same feeding point (input-output terminal) for a plurality of different frequencies, a plurality of RF circuits that process multiple frequencies can be integrated and downsizing and cost reduction of the plurality of RF circuits are realized, and, moreover, the antenna itself can be made smaller because of including the single feeding point only. In the case of prior art antennas, to ensure electrically independent operations of a plurality of input-output terminals (feeding points), finite space is required between the terminals and provision of such space has been a bottleneck in downsizing the antenna itself.

The reason why the single feeding point could be set up for multiple frequencies in the present invention is owing to the invention of a new resonant circuit design technique different from the prior art. Resonant circuits included in the multi-mode antenna of the present invention do not perform action which has been applied in prior art; i.e., a resonant circuit is opened or short-circuited for a certain frequency and electrically disconnects a part of the radiating conductor from the other part. Instead, in this invention, the radiating conductor and a plurality of resonant circuits connected to it operate in unison. In consequence, taken as a whole, the single feeding point of the multi-mode antenna assumes an impedance matching with the impedance in the RF circuit for multiple frequencies, and matching between the characteristic impedance in free space and the characteristic impedance in the RF circuit is attained.

Designing the resonant circuits according to the present invention is performed such that the radiating conductor is regarded as a distributed resonant circuit comprising a capacitance component with a resistance component and an inductance component. According to the design method of the present invention, for example, for the structures shown in FIGS. 11A, 11B, and 11C, subject to the values of the elements of the resonant circuits shown in these figures and the radiating conductor dimensions, with regard to two-mode operation for 1 GHz and 2 GHz, good impedance matching equal to or less than a standing wave ratio of 2 (VSWR<2) is ensured over bandwidths of 3% and 5.5% respectively for the above frequencies and bands.

BRIEF DESCRIPTION OF DRAWINGS

FIGS. 10A1, 10A2, 10B1, and 10B2 are circuit schematics to explain the resonant circuits for use in the multi-mode antenna of the present invention;

BEST MODE FOR CARRYING OUT THE INVENTION

Figure 1:
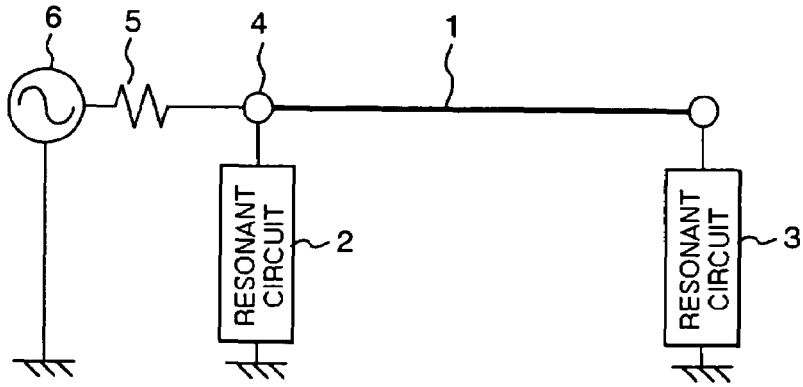
FIG. 1 is a structural diagram to explain one embodiment of a multi-mode antenna of the present invention.

The multi-mode antenna and the RF module using it in accordance with the present invention will be described hereinafter more fully with reference to several embodiments shown in the drawings. In the drawings, functionally identical components are assigned the same reference numbers and their explanation is not repeated.

Figure 2:
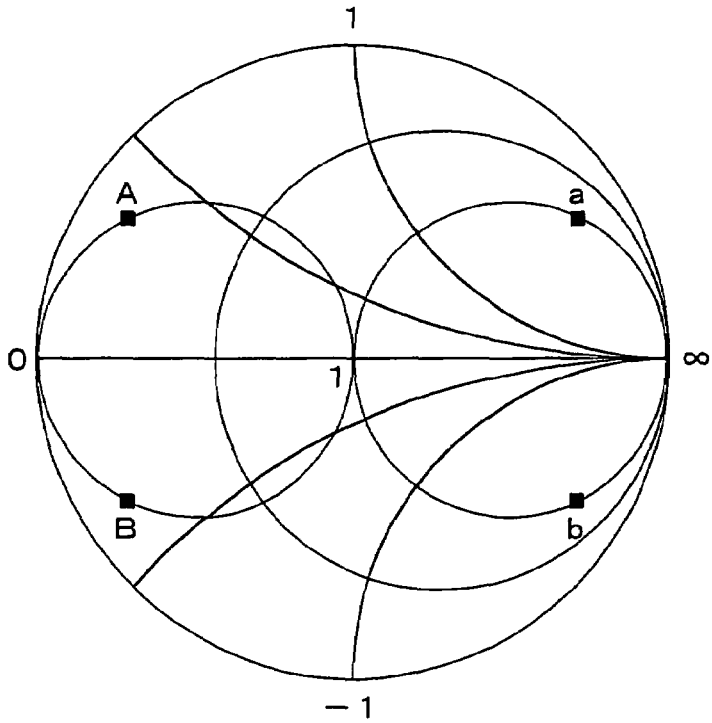
FIG. 2 is a Smith chart to explain the characteristics of resonant circuits of the multi-mode antenna.
Figure 3:
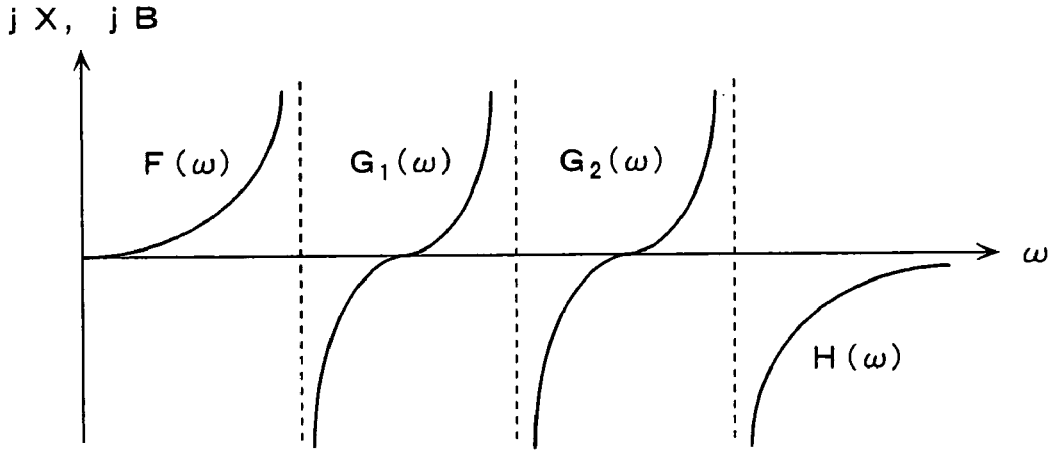
FIG. 3 is a curve graph chart to explain a reactance function of the resonant circuits of the multi-mode antenna.

One embodiment of the present invention is described with FIGS. 1, 2, and 3. FIG. 1 is a structural diagram showing the components of a multi-mode antenna embodiment of the present invention and their connections. FIG. 2 and FIG. 3 are a Smith chart and a reactance function characteristic graph chart, respectively, to explain the characteristics of resonant circuits in FIG. 1.

In FIG. 1, the antenna has a structure in which a first one-port resonant circuit 2 is connected between one end of a radiating conductor 1 which radiates electromagnetic waves with multiple frequencies and a ground potential point, a second one-port resonant circuit 3 is connected between the other end of the radiating conductor 1 and a ground potential point, and a point at which the radiating conductor 1 and the one-port resonant circuit 2 are connected functions as a single feeding point 4. To the feeding point 4, an RF circuit represented as a series equivalent circuit consisting of a characteristic impedance 5 and a voltage source 6 is connected.

The resonant circuits 2 and 3 are represented as equivalent circuits, using reactance elements. That is, an equivalent circuit is formed by a resonant circuit consisting of a C (capacitance) element and an L (inductance) element. Examples hereof are shown in FIGS. 10A1, 10A2, 10B1, and 10B2. As will be described later, a two-mode antenna compatible with two frequencies can be realized by adopting either of the circuits of FIGS. 10A1 and 10A2 and a four-mode antenna compatible with four frequencies can be realized by adopting either of the circuits of FIGS. 10B1 and 10B. The circuit examples of the FIGS. 10A1, 10A2, 10B1, and 10B2 are equivalent circuit representations of resonant circuits formed of a minimum number of elements for the number of frequencies that are supported by the antenna.

At the feeding point 4, for multiple frequencies, the radiating conductor 1 and the second resonant circuit 3 are set to assume an admittance having a real part value approximately equaling a characteristic admittance equivalent to the characteristic impedance 5 in the RF circuit and a specific imaginary part value and the first resonant circuit 2 is set to have a susceptance value having an absolute value approximately equaling the specific imaginary part value, but with an inverse sign. The admittance with the susceptance value is set near a point A or B in FIG. 2, because the first resonant circuit 2 is connected in parallel with the RF circuit at the feeding point 4.

A circle on which the points A and B exist in FIG. 2 corresponds to the locus of the characteristic admittance represented as a pure resistance component equivalent to the characteristic impedance, when the Smith chart is normalized by the characteristic impedance 5 in the RF circuit.

Thus, when the points A and B exist on the locus of the characteristic admittance, a good matching between the RF circuit and the multi-mode antenna of the present invention can be achieved. Viewing from another perspective, in order to achieve the good matching state between the RF circuit and the multi-mode antenna of the present invention, it is required that the admittance with the susceptance value be present near the locus of the characteristic admittance.

To make the antenna of this embodiment operate as the multi-mode antenna compatible with multiple carriers, for the frequencies of the carriers, it is required that the admittance in view from the feeding point 4 toward the radiating conductor 1 be present near the point A or B in FIG. 2 and it is desirable that the admittance be present near the point A or B alternately between A and B or B and A in the frequency increase direction from one carrier frequency to another. Here, the point A represents a point in one semicircular portion where the susceptance value is positive of the characteristic admittance locus and the point B represents a point in the other semicircular portion where the susceptance value is negative. The reason hereof is described with FIG. 3.

In the equivalent circuit representation of the first resonant circuit 2, according to placement of the C (capacitance) and L (inductance) elements, the frequency characteristic of the susceptance of the first resonant circuit takes any form of the following: F and Gi; F, Gi, and H; Gi and H; and Gi only (i=1, 2, . . . ). The frequency characteristic of the susceptance value (jB) of the first resonant circuit 2 appears in a monotonically increasing function which continues to increase along the frequency axis, as shown in FIG. 3. This fact has already been proven from a relationship between a reactance function or susceptance function and a Hurwitz polynomial.

As will be appreciated from FIG. 3, the susceptance function alternates between pole and zero or zero and pole, as the frequency increases. The number of poles and zeros has one-to-one correspondence to the number of the C and L elements in the equivalent circuit representation of the resonant circuit and one L-C pair generates one pole or zero. That is, the circuit of FIG. 10A1 generates one pole and the circuit of FIG. 10A2 generates one zero. One alternation occurs across the circuits of the FIGS. 10A1 and 10A2 and the combination of these circuits is compatible with two frequencies. Three alternations occur across the circuits of FIGS. 10B1 and 10B2 and each circuit is compatible with two frequencies.

For the frequencies of multiple carriers that the antenna of this embodiment should transmit and receive as the multi-mode antenna, when the admittance in view from the feeding point 4 toward the radiating conductor 1 assumes values alternating between the points A and B, the first resonant circuit 2 that cancels out the susceptance component of the admittance at these points A and B can be configured in the equivalent circuit representation with a minimum number of elements. In this case, the sum of the number of poles and the number of zeros in the equivalent circuit representation of the first resonant circuit 2 will be equal to the number of the multiple frequencies. In this way, the first resonant circuit can be designed to be smaller with lower loss and, consequently, the antenna can be downsized. Moreover, as is apparent from FIG. 3, abrupt impedance change in relation to an unwanted pole for the carriers with adjacent frequencies can be avoided and this produces an effect that the antenna taken as a whole has a broader bandwidth.

Thus, the present invention realizes good impedance matching between the RF circuit and free space at the single feeding point 4 and the energy of the electromagnetic waves with multiple frequencies coming to the antenna of the present invention can be conducted to the RF circuit efficiently. The effect hereof is realizing a suitable multi-mode antenna for multimedia wireless apparatus that provides the user with a plurality of wireless information transmission services, using the carriers with different frequencies.

Figure 4:
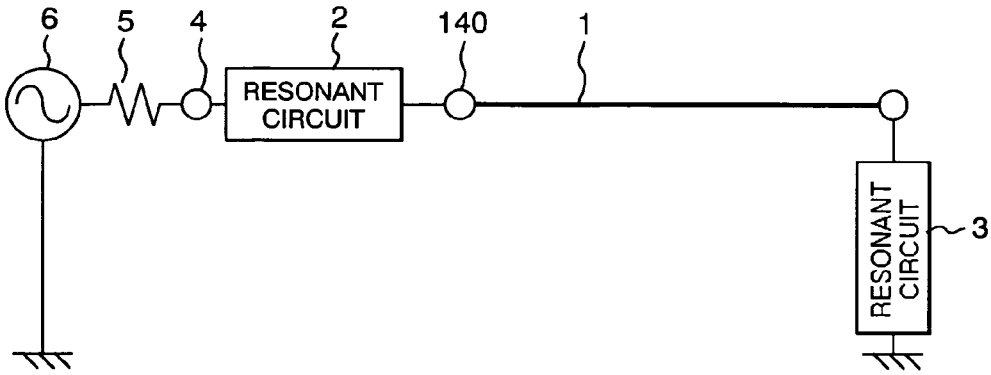
FIG. 4 is a structural diagram to explain another multi-mode antenna embodiment of the present invention.

Another embodiment of the present invention is described with FIGS. 4, 2, and 3. FIG. 4 is a structural diagram showing the components of another multi-mode antenna embodiment of the present invention and their connections. Difference from the embodiment of FIG. 1 lies in the first one-port resonant circuit 2, one end of which not connecting to the radiating conductor 1 directly attaches to the feeding point 4 without the connection to a ground potential point.

In this embodiment also, for the resonant circuits 2 and 3, the circuits shown in, e.g., FIGS. 10A1, 10A2, 10B1, and 10B2 are employed.

At a connection point 140 between the first one-port resonant circuit 2 and the radiating conductor 1, for multiple frequencies, the radiating conductor 1 and the second resonant circuit 3 assume an impedance having a real part value approximately equaling the characteristic impedance 5 in the RF circuit and a specific imaginary part value and the first resonant circuit 2 has a reactance value having an absolute value approximately equaling the specific imaginary part value, but with an inverse sign.

The impedance with the reactance value is set near a point a orb in FIG. 2, because the first resonant circuit 2 is connected in series with the RF circuit at the feeding point 4. A circuit on which the points a and b exist in FIG. 2 corresponds to the locus of the characteristic impedance represented as a pure resistance component equivalent to the characteristic impedance, when the Smith chart is normalized by the characteristic impedance in the RF circuit.

Thus, when the points a and b exist on the locus of the characteristic impedance, a good matching between the RF circuit and the multi-mode antenna of the present invention can be achieved. Viewing from another perspective, in order to achieve the good matching state between the RF circuit and the multi-mode antenna of the present invention, it is required that the impedance with the reactance value be present near the locus of the characteristic impedance.

To make the antenna of this embodiment operate as the multi-mode antenna compatible with multiple carriers, for the frequencies of the carriers, it is required that the impedance in view from the connection point 140 toward the radiating conductor 1 be present near the point a or b in FIG. 2 and it is desirable that the impedance be present near the point a or b alternately between a and b or a and b in the frequency increase direction from one carrier frequency to another. Here, the point a represents a point in one semicircular portion where the reactance value is positive of the characteristic impedance locus and the point b represents a point in the other semicircular portion where the reactance value is negative. The reason and effect hereof are the same as stated for the embodiment of FIG. 1. The sum of the number of poles and the number of zeros in the equivalent circuit representation of the first resonant circuit 2 will be equal to the number of the multiple frequencies.

The effect of this embodiment is the same as the embodiment of FIG. 1 and, moreover, this embodiment has an effect that the first resonant circuit 2 can be realized by an equivalent circuit with a smaller range of the values of the elements, when the imaginary part of the impedance that the radiating conductor 1 and the second resonant circuit 3 assume at the connection point 140 has a great absolute value.

Figure 5:
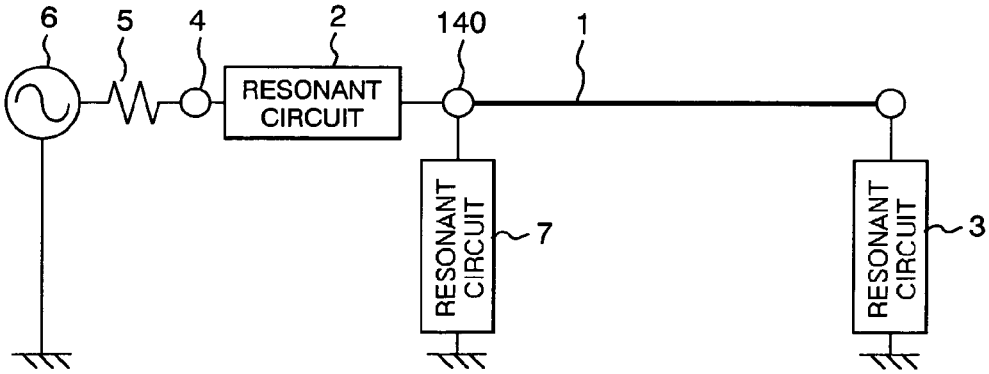
FIG. 5 is a structural diagram to explain another multi-mode antenna embodiment of the present invention.

Another embodiment of the present invention is described with FIG. 5. FIG. 5 is a structural diagram showing the components of another multi-mode antenna embodiment of the present invention and their connections. Difference from the embodiment of FIG. 2 lies in that a third one-port resonant circuit 7 is inserted between the connection point 140 and a ground terminal point.

In this embodiment, a four-mode antenna can be realized by realizing the second resonant circuit 3 according to, e.g., the equivalent circuit configurations of FIGS. 10B1 and 10B2 and by realizing the first resonant circuit 2 and the third resonant circuit 7 according to, e.g., the equivalent circuit configurations of FIGS. 10A1 and 10A2. The sum of the number of poles and the number of zeros in the equivalent circuit representations of the first one-port resonant circuit 2 and the third one-port resonant circuit 7 connected to the connection point 140 will be equal to the number of multiple frequencies to be supported by the antenna.

The effect of this embodiment is the same as the embodiment of FIG. 1 and, moreover, this embodiment has an effect that the third resonant circuit 7 can be realized by an equivalent circuit with a smaller range of the values of the elements, when the imaginary part of the impedance that the radiating conductor 1 and the second resonant circuit 3 assume at the connection point 140 has an absolute value that changes, or increases or decreases, depending on the above multiple frequencies.

Figure 6:
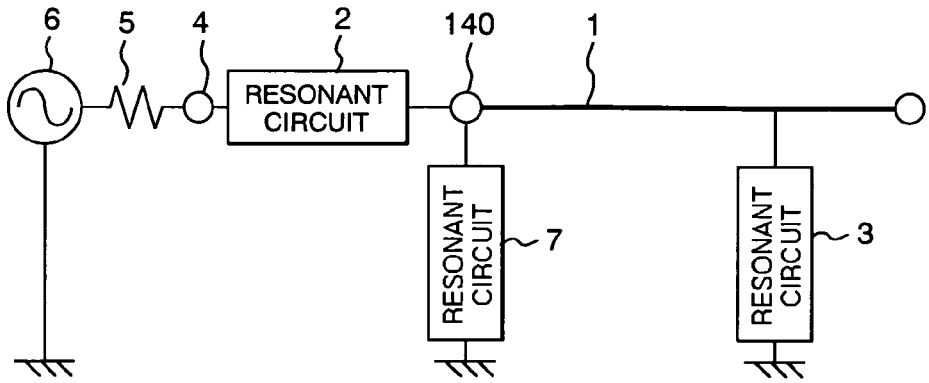
FIG. 6 is a structural diagram to explain another multi-mode antenna embodiment of the present invention.

Another embodiment of the present invention is described with FIG. 6. FIG. 6 is a structural diagram showing the components of another multi-mode antenna embodiment of the present invention and their connections. Difference from the embodiment of FIG. 5 lies in that the second one-port resonant circuit 3 is formed between a point along the radiating conductor 1, not its end, and a ground potential point. Again, in this embodiment also, a four-mode antenna can be realized by realizing the second resonant circuit 3 according to, e.g., the equivalent circuit configurations of FIGS. 10B1 and 10B2 and by realizing the first resonant circuit 2 and the third resonant circuit 7 according to, e.g., the equivalent circuit configurations of FIGS. 10A1 and 10A2.

The effect of this embodiment is the same as the embodiment of FIG. 5 and, moreover, this embodiment has effects that the absolute value for the imaginary part of the impedance that the radiating conductor 1 and the second resonant circuit 3 assume at the connection point 140 is restricted from changing, depending on the multiple frequencies to be supported by the antenna, and the first and third resonant circuits 2 and 7 can be realized by an equivalent circuit with a smaller range of the values of the elements.

Figure 7:
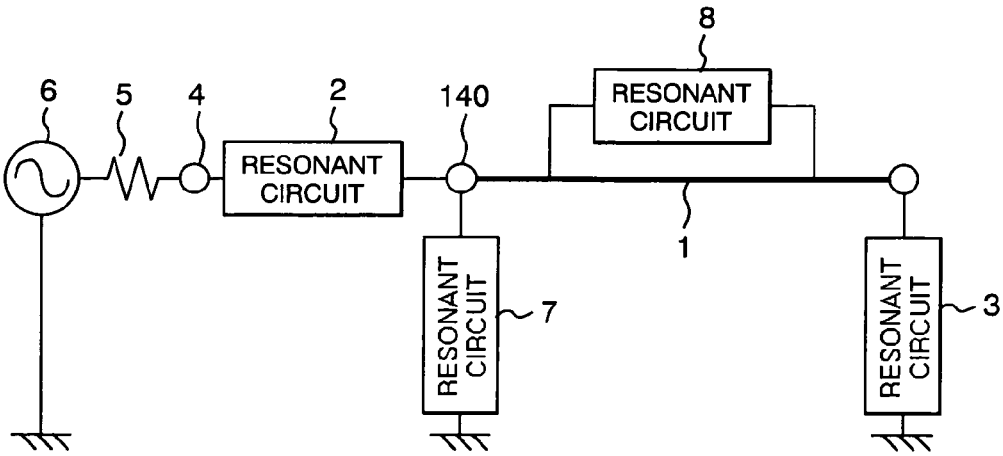
FIG. 7 is a structural diagram to explain another multi-mode antenna embodiment of the present invention.

Another embodiment of the present invention is described with FIG. 7. FIG. 7 is a structural diagram showing the components of another multi-mode antenna embodiment of the present invention and their connections. Difference from the embodiment of FIG. 5 lies in that a fourth one-port resonant circuit 8 is formed between one point and another point along the resonating conductor 1. In this embodiment, a four-mode antenna can be realized by realizing the first to fourth resonant circuits 2, 3, 7, and 8 according to, e.g., the equivalent circuit configurations of FIGS. 10A1 and 10A2.

The effect of this embodiment is the same as the embodiment of FIG. 5 and, as is the case for the embodiment of FIG. 6, this embodiment has effects that the absolute value for the imaginary part of the impedance that the radiating conductor 1 and the second resonant circuit 3 assume at the connection point 140 is restricted from changing, depending on the multiple frequencies to be supported by the antenna, and the first and third resonant circuits 2 and 7 can be realized by an equivalent circuit with a smaller range of the values of the elements.

Figure 8:
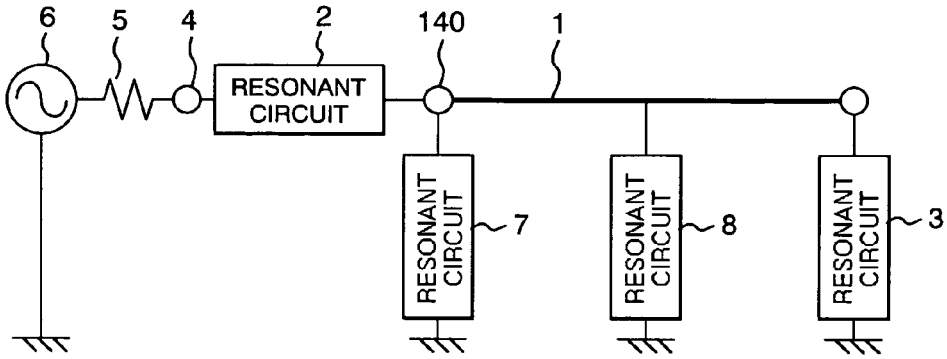
FIG. 8 is a structural diagram to explain another multi-mode antenna embodiment of the present invention.

Another embodiment of the present invention is described with FIG. 8. FIG. 8 is a structural diagram showing the components of another multi-mode antenna embodiment of the present invention and their connections. Difference from the embodiment of FIG. 5 lies in that a fourth one-port resonant circuit 8 is formed between one point along the resonating conductor 1 and a ground potential point. Again, in this embodiment also, a four-mode antenna can be realized by realizing the first to fourth resonant circuits 2, 3, 7, and 8 according to, e.g., the equivalent circuit configurations of FIGS. 10A1 and 10A2.

The effect of this embodiment is the same as the embodiment of FIG. 7 and, even when the physical size of the radiating conductor 1 is small and it is hard to form two points between which the fourth resonant circuit 8 should be connected along the radiating conductor, as is the case for the embodiment of FIG. 7, this embodiment has effects that the absolute value for the imaginary part of the impedance that the radiating conductor 1 and the second resonant circuit 3 assume at the connection point 140 is restricted from changing, depending on the multiple frequencies to be supported by the antenna, and the first and third resonant circuits 2 and 7 can be realized by an equivalent circuit with a smaller range of the values of the elements.

Figure 9:
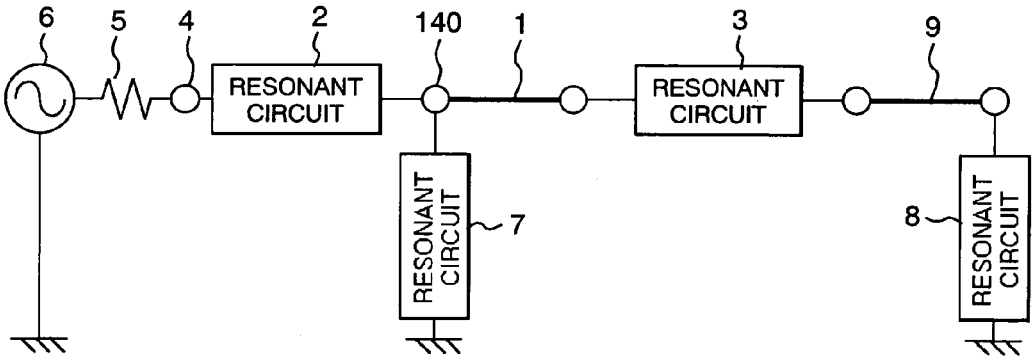
FIG. 9 is a structural diagram to explain another multi-mode antenna embodiment of the present invention.

Another embodiment of the present invention is described with FIG. 9. FIG. 9 is a structural diagram showing the components of another multi-mode antenna embodiment of the present invention and their connections. Difference from the embodiment of FIG. 5 lies in that one end of the second one-port resonant circuit 3, the end not connecting to the radiation conductor 1, is disconnected from the ground potential point and attached to one end of a second radiating conductor 9 and a fourth one-port resonant circuit 8 is formed between the other end of the radiation conductor 9 and a ground potential point. In this embodiment, a four-mode antenna can be realized by realizing the first to fourth resonant circuits 2, 3, 7, and 8 according to, e.g., the equivalent circuit configurations of FIGS. 10A1 and 10A2.

According to this embodiment, even when there is spatial limitation that makes it hard to form the radiating conductor of the antenna of the present invention as a single continuous structure, as is the case for the embodiment of FIG. 7, this embodiment has effects that the absolute value for the imaginary part of the impedance that the radiating conductor 1 and the second resonant circuit 3 assume at the connection point 140 is restricted from changing, depending on the multiple frequencies to be supported by the antenna, and the first and third resonant circuits 2 and 7 can be realized by an equivalent circuit with a smaller range of the values of the elements. Although an instance where the radiating conductor is divided into two continuo bodies is presented in this embodiment, dividing it into two bodies is not always required and it is possible to divide it into three or more continuous bodies; even in this case, an antenna configuration having the same effects can easily be realized by analogy with the embodiments of this figure and FIGS. 7 and 8.

Figure 11A:
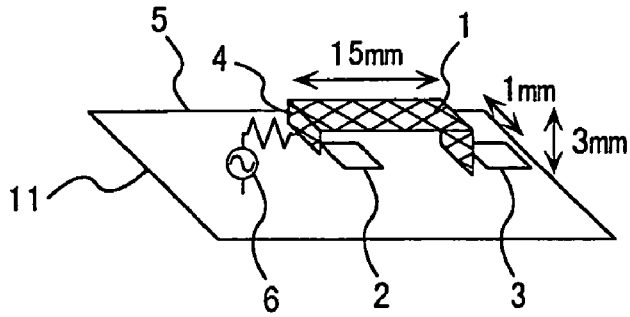
FIG. 11A is a perspective view to explain another multi-mode antenna embodiment of the present invention.
Figure 11B:
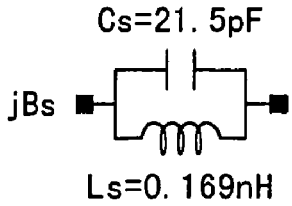
FIGS. 11B and 11C are circuit schematics to explain the resonant circuits employed in the embodiment shown in FIG. 11A.
Figure 11C:
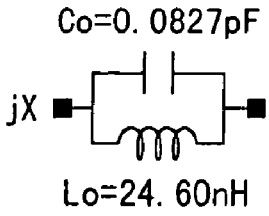

Another embodiment of the present invention is described with FIGS. 11A through 11C. FIG. 11A shows a design example of a small multi-mode antenna embodiment of the present invention; this design takes as an example the configuration of the embodiment of FIG. 1. The radiating conductor 1 is formed by bending a 1 mm wide strip conductor and its rectangular plate portion which is 1 mm wide and 15 mm long is placed above a ground substrate 11 with a gap of 3 mm from the ground substrate 11. Both ends of the rectangular plate portion are bent vertically toward the ground substrate 11 to form extensions with a length of approximately 3 mm and keeping a width of 1 mm in order not to bring the plate portion in electrical contact with the ground substrate.

The first one-port resonant circuit 2 is formed between one end of the strip radiating conductor 1 with the bent ends and the ground substrate and the second one-port resonant circuit 3 is formed between the other end of the conductor 1 and the ground substrate. The feeding point 4 is set up at the connection point at which the radiating conductor 1 and the first resonant circuit 2 are connected, also connecting to the RF circuit represented as the equivalent circuit consisting of the characteristic impedance 5 and the voltage source 6.

In this structure, by configuring the first resonant circuit 2 as an equivalent circuit that assumes susceptance jBs (Cs=21.5 pF, Ls=0.169 nH) shown in FIG. 11B and configuring the second resonant circuit 3 as an equivalent circuit that assume reactance jX (Co=0.0827 pF, Lo=24.60 nH) shown in FIG. 11C, it was able to get bandwidths of 3% and 5% satisfying that Vertical Standing Wave Ratio (VSWR) <2, respectively, for carrier frequencies of 1 GHz and 2 GHz and to realize a two-mode antenna.

Figure 12A:
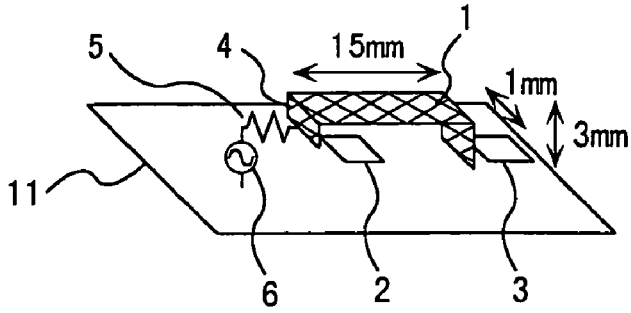
FIG. 12A is a perspective view to explain another multi-mode antenna embodiment of the present invention.
Figure 12B:
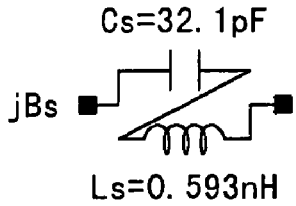
FIGS. 12B and 12C are circuit schematics to explain the resonant circuits employed in the embodiment shown in FIG. 12A.
Figure 12C:
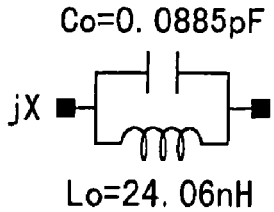

Another embodiment of the present invention is described with FIGS. 12A through 12C. FIG. 12A shows another design example of a small multi-mode antenna embodiment of the present invention; this design takes as an example the same configuration as in the embodiment of FIG. 11, wherein the radiating conductor structure is coupled to the resonant circuits. In this structure, by configuring the first resonant circuit 2 as an equivalent circuit that assumes susceptance jBs (Cs=32.1 pF, Ls=0.593 nH) shown in FIG. 12B and configuring the second resonant circuit 3 as an equivalent circuit that assume reactance jX (Co=0.0885 pF, Lo=24.06 nH) shown in FIG. 12C, it was able to get bandwidths of 0.7% and 10% satisfying that Vertical Standing Wave Ratio (VSWR)<2, respectively, for carrier frequencies of 1 GHz and 2 GHz and to realize a two-mode antenna in which a significant difference lies between the bandwidths to be supported by the antenna for the above two carrier frequencies.

Figure 13:
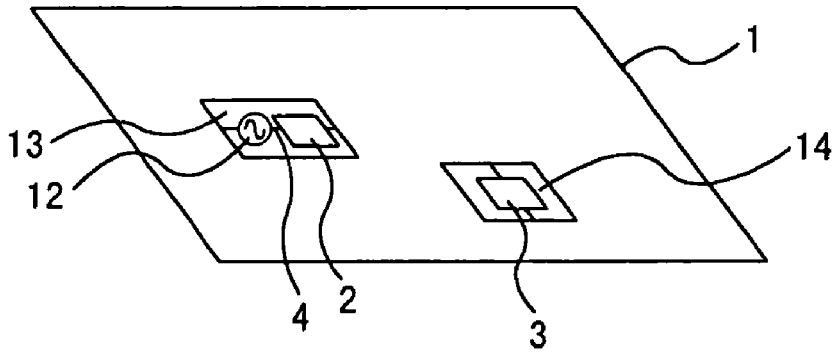
FIG. 13 is a perspective view to explain another multi-mode antenna embodiment of the present invention.

Another embodiment of the present invention is described with FIG. 13. FIG. 13 is a structural diagram showing the components of a small multi-mode antenna embodiment of the present invention and their connections. Difference from the foregoing embodiments lies in that the radiating conductor 1 incorporates ground potential integral with it in structure. In this embodiment, the series connection of the characteristic impedance 5 and the voltage source 6 is represented as a single exciter 12 for clarity of the drawing.

Because the plate-like radiating conductor 1 incorporates ground potential integral with it in this embodiment, one end of the first one-port resonant circuit 2 is coupled to one end of the exciter 12 at the feeding point 4, both ends of the series connection of the first resonant circuit 2 and the exciter 12 are electrically connected to the radiating conductor 1 in a first gap 13, and both ends of the second one-port resonant circuit 3 are electrically connected to the radiating conductor 1 in a second gap 14.

The equivalent circuit in this embodiment structure is equivalent to the embodiment of FIG. 4 and this embodiment can provide the same effect as the embodiment of FIG. 4. In this embodiment structure, because the antenna itself incorporates ground potential integral with it, this embodiment has the following effects: this antenna is allowed to operate independently of a circuit board that provides ground potential to the RF circuit and its design can easily be made without taking the influence of this circuit board into consideration; moreover, an antenna meets specifications requiring that the radiating conductor and the RC circuit be grounded separately is realized.

Figure 14:
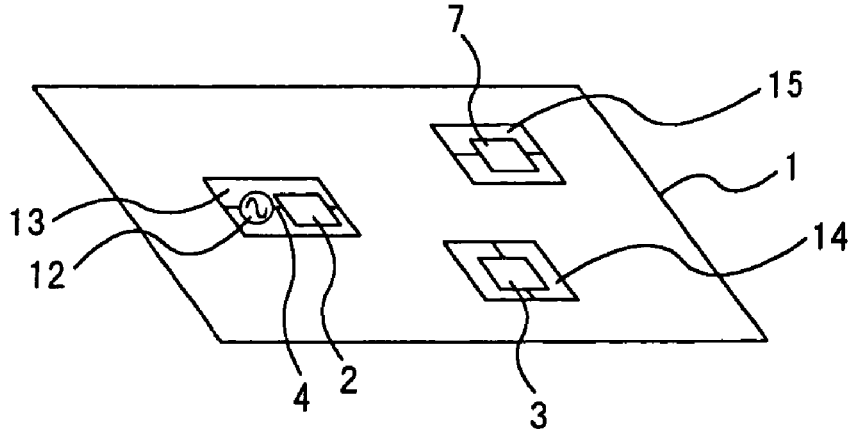
FIG. 14 is a perspective view to explain an other multi-mode antenna embodiment of the present invention.

Another embodiment of the present invention is described with FIG. 14. FIG. 14 is a structural diagram showing the components of a small multi-mode antenna embodiment of the present invention and their connections. Difference from the embodiment of FIG. 13 lies in that the radiating conductor 1 has a third gap 15 and the third one-port resonant circuit 7 is electrically connected to the radiating conductor 1 in the third gap 15.

The equivalent circuit in this embodiment structure is equivalent to the embodiment of FIG. 5 or FIG. 6 and this embodiment can provide the same effect as the embodiment of FIG. 5 or FIG. 6. As is the case for the embodiment of FIG. 13, this embodiment structure has the following effects: it enables simple design without taking the influence of the RF circuit board into consideration and realizes an antenna meeting specifications requiring that the radiating conductor and the RC circuit be grounded separately.

Figure 15:
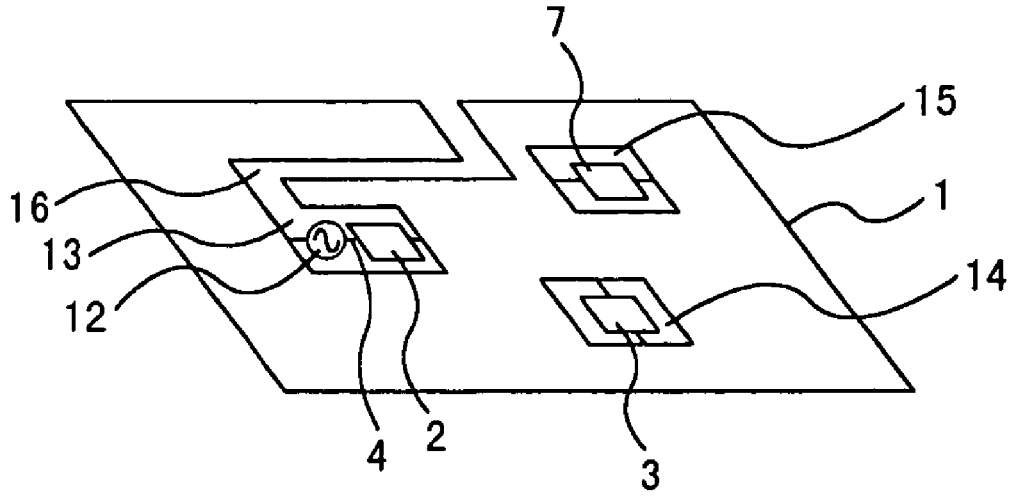
FIG. 15 is a perspective view to explain another multi-mode antenna embodiment of the present invention.

Another embodiment of the present invention is described with FIG. 15. FIG. 15 is a structural diagram showing the components of a small multi-mode antenna embodiment of the present invention and their connections. Difference from the embodiment of FIG. 14 lies in that the first gap is integral with a slit 16 which is formed in the radiating conductor 1.

According to this embodiment, because the current near the exciter can be controlled by shaping the radiating conductor 1 with the slit 16, impedance change with frequency change at both ends of the series connection circuit of the first resonant circuit 2 and the exciter 12 can be decreased, and, inconsequence, the bandwidths for different multiple carrier frequencies can be expanded. Although the slit 16 is not closed in the conductor in this embodiment, it can easily be reasoned by analogy that an enclosed, so-called slot shape can yield the same effect.

Figure 16:
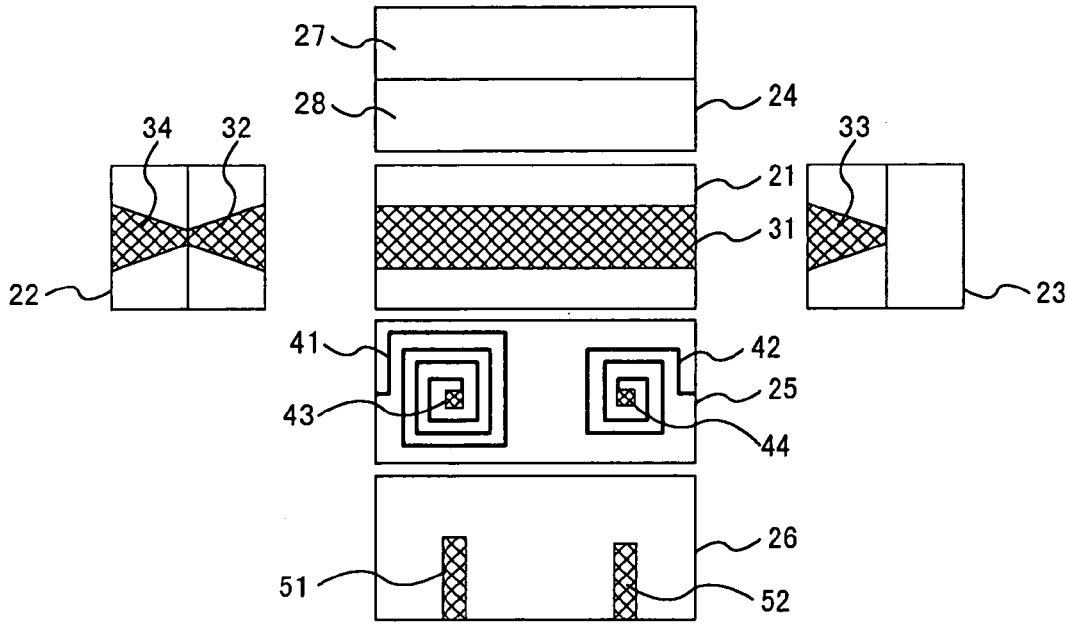
FIG. 16 is a development view to explain another multi-mode antenna embodiment of the present invention.

Another embodiment of the present invention is described with FIG. 16. FIG. 16 is a diagram showing a small multi-mode antenna structure in which the invention is embodied, formed by employing a multilayer substrate, in relation to its fabrication method, wherein the antenna structure is made up of a top layer 21 which forms the top surface, a left side surface 22, a right side surface 23, a front surface 24, an intermediate layer 25 between layers, and a bottom layer 26 which forms the bottom surface.

To form this structure, by a multilayer process, a top layer pattern for the top layer 21, an upper dielectric substrate 28 consisting of a dielectric, on the top surface of which the top layer 21 is placed, an intermediate layer pattern for the intermediate layer 25 under the bottom surface of the upper dielectric substrate 28, a lower dielectric substrate 27 in contact with the intermediate layer 25, and a bottom layer pattern for the bottom layer 26 under the bottom surface of the lower dielectric substrate 27 consisting of a dielectric are formed. The intermediate layer 25 may be formed on the top surface of the lower dielectric substrate 27.

A radiating conductor top layer pattern 31 which forms the top layer pattern for the top layer 21 is printed on the top surface of the upper dielectric substrate 28 by a thick film process or thin film process. On a left side surface 22 portion of the upper dielectric substrate 28, a radiating conductor left side pattern 32 is printed by thick film or thin film process. On a right side surface 23 portion of the upper dielectric substrate 28, a radiating conductor right side pattern 33 is printed by thick film or thin film process. On the intermediate layer 25 under the bottom surface of the upper dielectric substrate 28 (or on the top surface of the lower dielectric substrate 27), a first spiral conductor pattern 41 and a second spiral conductor pattern 42 which form the intermediate layer pattern are printed by thin film process. On a left side surface 22 portion of the lower dielectric substrate 27, a feeding conductor pattern 34 is printed by thick film or thin film process. On the bottom layer 26 under the bottom surface of the lower dielectric substrate 27, a first strip ground conductor pattern 51 and a second strip ground conductor pattern 52 which form the bottom layer pattern are printed by thick film or thin film process.

After these patterns are printed as above, the bottom surface of the upper dielectric substrate 28 and the top surface of the lower dielectric substrate 27 are bonded together and the multilayer structure is completed. For bonding, for example, the following method is used: form a bonding layer on the bottom surface of the substrate 28 or the top surface of the substrate 27, place the upper substrate on the lower substrate, and apply heat and pressure to bond the substrates together.

In the multilayer structure, the following electrical joints are formed. The radiating conductor top layer pattern 31, the radiating conductor left side pattern 32, and the radiating conductor right side pattern 33 are joined electrically. The radiating conductor left side pattern 32 and the first spiral conductor pattern 41 are joined electrically. The radiating conductor right side pattern 33 and the second spiral conductor pattern 42 are joined electrically. The feeding conductor pattern 34 and the radiating conductor left side pattern 32 are jointed electrically. The first spiral conductor pattern 41 and the first strip ground conductor pattern 51 are electrically joined via a first through hole 43 which is formed through the lower dielectric substrate 27. The second spiral conductor pattern 42 and the second strip ground conductor pattern 52 are electrically joined via a second through hole 44 which is formed through the lower dielectric substrate 27.

In the structure of this embodiment, permittivity of the upper dielectric substrate 28 and that of the lower dielectric substrate 27 may be identical or different. However, when they are different, it is preferable to make the permittivity of the upper dielectric substrate 28 lower than that of the lower dielectric substrate 27 in order to decrease the coupling between the radiating conductor pattern 31 and the spiral conductor patterns 41, 42 and increase the efficiency of radiation of electromagnetic waves from the radiating conductor patterns 31, 32, 33 to free space.

Moreover, in this embodiment, it is possible to replace the upper dielectric substrate 28 and the lower dielectric substrate 27, respectively, with upper and lower magnetic substrates made of a magnetic substance. In that event, permeability of the upper magnetic substrate and that of the lower magnetic substrate may be identical or different. However, when they are different, it is preferable to make the permeability of the upper magnetic substrate lower than that of the lower magnetic substrate.

In this embodiment structure, the equivalent circuit representations of resonant circuit structures can be realized with the spiral conductors 41, 42 and the through holes 44. By setting up the feeding point anywhere in the feeding conductor pattern 34 and connecting the first and second strip ground conductors 51, 52 to the ground potential of the RF circuit, the structure of the embodiment of the FIG. 1 can be realized.

Therefore, according to this embodiment, the multi-mode antenna in which the invention is embodied can be fabricated by way of multilayer process; consequently, downsizing the multi-mode antenna and cost reduction by manufacturing economy of scale are achieved.

Figure 17:
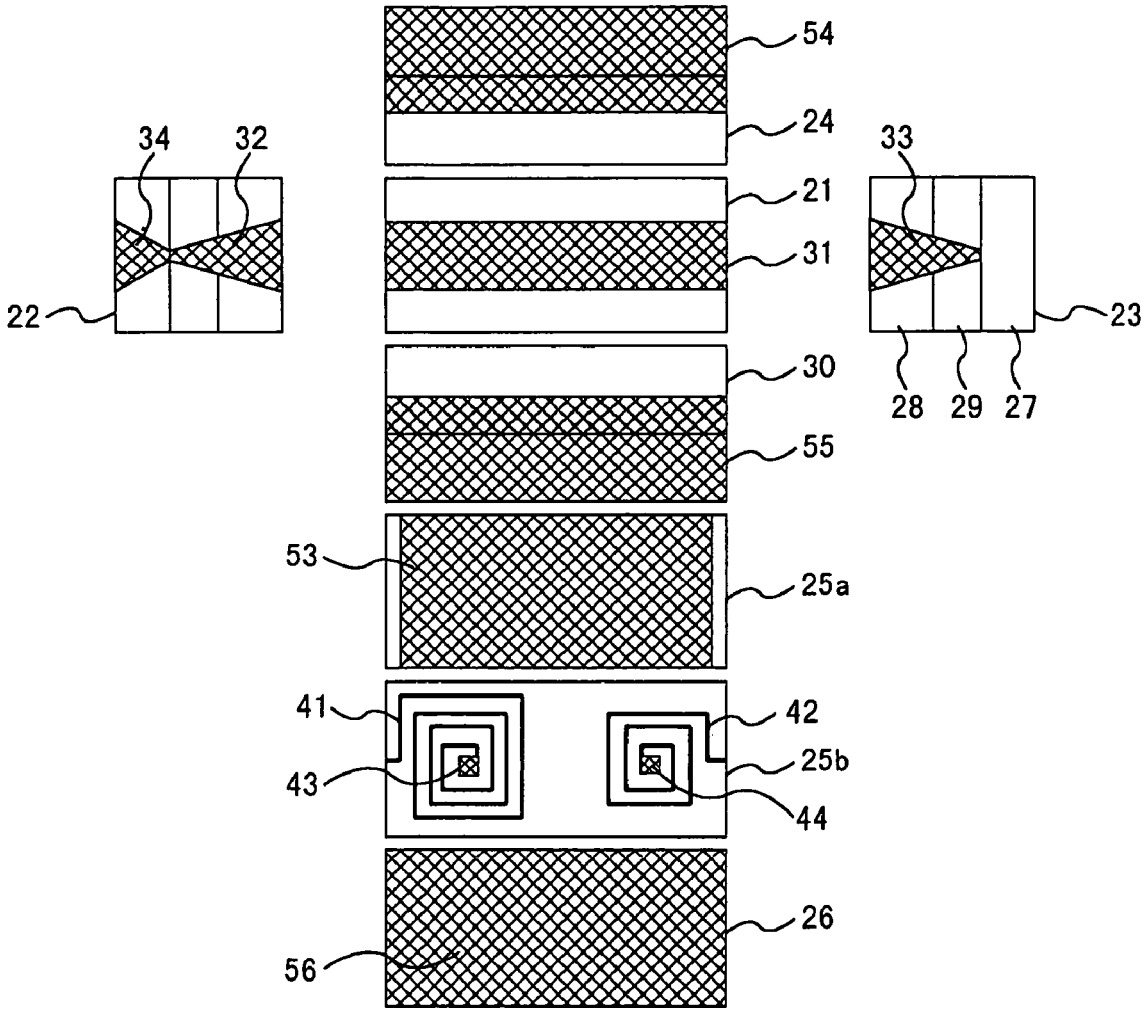
FIG. 17 is a development view to explain another multi-mode antenna embodiment of the present invention.

Another embodiment of the present invention is described with FIG. 17. FIG. 17 is a diagram showing a small multi-mode antenna structure in which the invention is embodied in relation to its multilayer substrate fabrication method, wherein the antenna structure is made up of a top layer 21 which forms the top surface, a left side surface 22, a right side surface 23, a front surface 24, a first intermediate layer 25*a* between layers, a second intermediate layer 25*b* between layers, a bottom layer 26 which forms the bottom surface, and a rear surface 30.

To form this structure, by multilayer process, the top layer pattern for the top layer 21, the upper dielectric substrate 28 consisting of a dielectric, on the top surface of which the top layer 21 is placed, a first intermediate layer pattern for the first intermediate layer 25*a* under the bottom surface of the upper dielectric substrate 28, an intermediate dielectric substrate 29 in contact with the first intermediate layer 25*a*, a second intermediate layer pattern for the second intermediate layer 25*b* under the bottom surface of the intermediate dielectric substrate 29, the lower dielectric substrate 27 in contact with the second intermediate layer 25*b*, and the bottom layer pattern for the bottom layer 26 under the bottom surface of the lower dielectric substrate 27 are formed. The first intermediate layer 25*a* may be formed on the top surface of the intermediate dielectric substrate 29 and the second intermediate layer 25*b* may be formed on the top surface of the lower dielectric substrate 27.

The radiating conductor top layer pattern 31 which forms the top layer pattern for the top layer 21 is printed on the top surface of the upper dielectric substrate 28 by thick film or thin film process. On left side surface 22 portions of the upper dielectric substrate 28 and intermediate dielectric substrate 29, the radiating conductor left side pattern 32 is printed by thick film or thin film process. On right side surface 23 portions of the upper dielectric substrate 28 and intermediate dielectric substrate 29, the radiating conductor right side pattern 33 is printed by thick film or thin film process. On the first intermediate layer 25*a* under the bottom surface of the upper dielectric substrate 28 (or on the top surface of the intermediate dielectric substrate 29), a shielding conductor top surface pattern 53 which forms the first intermediate pattern is printed by thin film process. On the second intermediate layer 25*b* under the bottom surface of the intermediate dielectric substrate 29 (or on the top surface of the lower dielectric substrate 27), the first spiral conductor pattern 41 and second spiral conductor pattern 42 which form the second intermediate layer pattern are printed by thin film process. On a left side surface 22 portion of the lower dielectric substrate 27, the feeding conductor pattern 34 is printed by thick film or thin film process. On the bottom layer 26 under the bottom surface of the lower dielectric substrate 27, a shielding conductor bottom surface pattern 56 which forms the bottom layer pattern is printed by thick film or thin film process. On front surface 24 portions of the intermediate dielectric substrate 29 and lower dielectric substrate 27, a shielding conductor front surface pattern 54 is printed by thick film or thin film process. On rear surface 30 portions of the intermediate dielectric substrate 29 and lower dielectric substrate 27, a shielding conductor rear surface pattern 55 is printed by thick film or thin film process.

After these patterns are printed as above, the bottom surface of the upper dielectric substrate 28 and the top surface of the intermediate dielectric substrate 29 are bonded together and the bottom surface of the intermediate dielectric substrate 29 and the top surface of the lower dielectric substrate 27 are bonded together, and the multilayer structure is completed. For bonding, for example, the following method is used: forming bonding layers on the bottom surface of the substrate 28 or the top surface of the substrate 29 and on the bottom surface of the substrate 29 or the top surface of the substrate 27, pile these substrates, and applying heat and pressure to bond them together.

In the multilayer structure, the following electrical joints are formed. The radiating conductor top layer pattern 31, the radiating conductor left side pattern 32, and the radiating conductor right side pattern 33 are joined electrically. The radiating conductor left side pattern 32 and the first spiral conductor pattern 41 are joined electrically. The radiating conductor right side pattern 33 and the second spiral conductor pattern 42 are joined electrically. The feeding conductor pattern 34 and the radiating conductor left side pattern 32 are jointed electrically. The first spiral conductor pattern 41 and the shielding conductor bottom surface pattern 56 are electrically joined via the first through hole 43 which is formed through the lower dielectric substrate 27. The second spiral conductor pattern 42 and the shielding conductor bottom surface pattern 56 are electrically joined via the second through hole 44 which is formed through the lower dielectric substrate 27. The shielding conductor front surface pattern 54 is electrically joined to the shielding conductor top surface pattern 53 and the shielding conductor bottom surface pattern 56. The shielding conductor rear surface pattern 55 is electrically joined to the shielding conductor top surface pattern 53 and the shielding conductor bottom surface pattern 56.

In the structure of this embodiment also, the permittivity values of the upper dielectric substrate 28, lower dielectric substrate 27, and intermediate dielectric substrate 29 may be identical or different. However, when they are different, it is preferable to make the permittivity of an upper-layer dielectric substrate lower.

Moreover, in this embodiment, it is possible to replace the upper dielectric substrate 28, lower dielectric substrate 27, and intermediate dielectric substrate 29, respectively, with upper, lower, and intermediate magnetic substrates made of a magnetic substance. In that event, the permeability values of the upper, lower, and intermediate magnetic substrates may be identical or different. However, when they are different, it is preferable to make the permeability of an upper-layer magnetic substrate lower.

In this embodiment structure, as is the case for the embodiment of FIG. 16, the structure of the embodiment of the FIG. 1 can be realized and the multi-mode antenna in which the invention is embodied can be fabricated by multilayer substrate fabrication method (multilayer process); consequently, downsizing the multi-mode antenna and cost reduction by manufacturing economy of scale can be achieved. As compared to the embodiment of FIG. 16, in this embodiment, the electromagnetic coupling between the radiating conductor and the resonant circuits is significantly suppressed, which yields an effect that design of the resonant circuits becomes easy.

Figure 18:
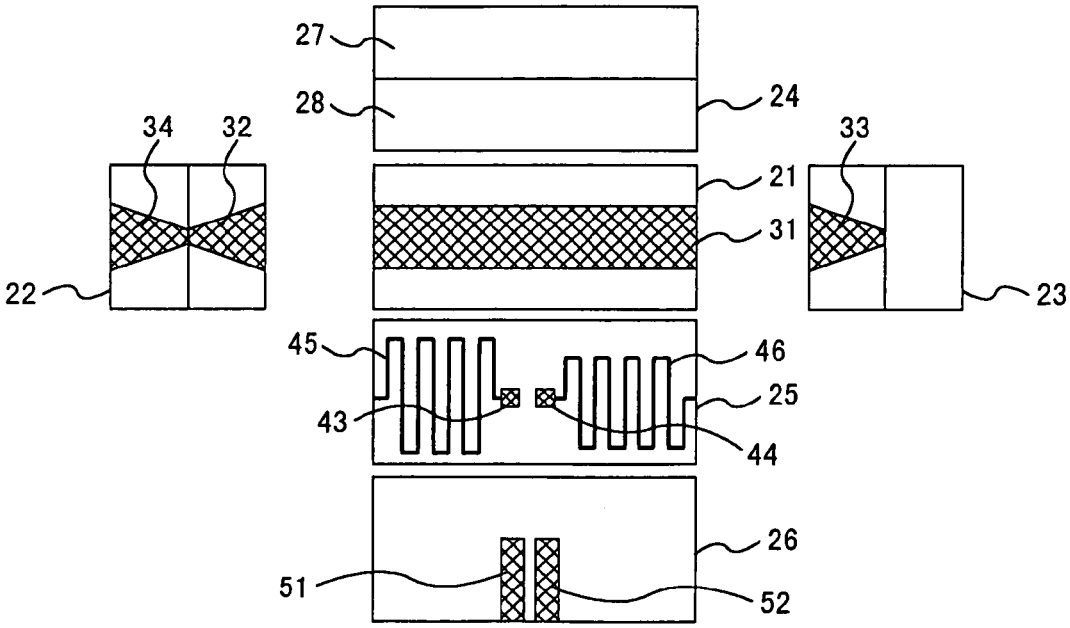
FIG. 18 is a development view to explain another multi-mode antenna embodiment of the present invention.

Another embodiment of the present invention is described with FIG. 18. FIG. 18 is a diagram showing a small multi-mode antenna structure in which the invention is embodied in relation to its multilayer substrate fabrication method, wherein the antenna structure is made up of the top layer 21 which forms the top surface, left side surface 22, right side surface 23, front surface 24, intermediate layer 25 between layers, and bottom layer 26 which forms the bottom surface, as is the case for the embodiment of FIG. 16.

Difference from the embodiment of FIG. 16 lies in that the spiral conductors 41 and 42 are replaced with meandering conductors 45, 46. By adoption of the meandering conductors, in an instance where the antenna in which the invention is embodied is applied to a ultra-high frequency range of a GHz band and above, the width of the meandering conductors can be wider than the width of the spiral conductors and, thus, the resistance loss of the conductors in this section can be reduced, which yields an effect that the antenna efficiency is enhanced.

Figure 19:
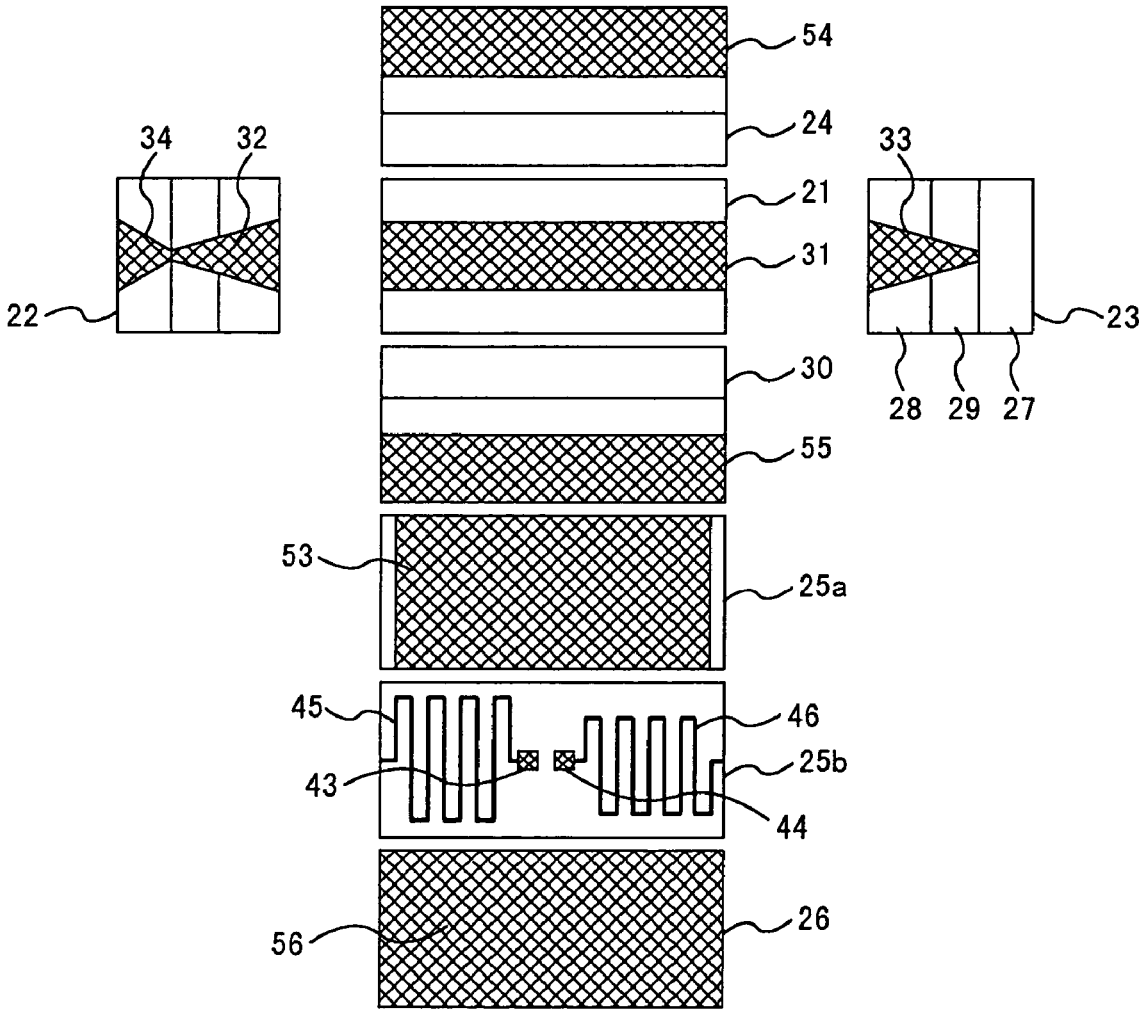
FIG. 19 is a development view to explain another multi-mode antenna embodiment of the present invention.

Another embodiment of the present invention is described with FIG. 19. FIG. 19 is a diagram showing a small multi-mode antenna structure in which the invention is embodied in relation to its multilayer substrate fabrication method, wherein the antenna structure is made up of the top layer 21 which forms the top surface, left side surface 22, right side surface 23, front surface 24, first intermediate layer 25*a* between layers, second intermediate layer 25*b* between layers, bottom layer 26 which forms the bottom surface, and rear surface 30, as is the case for the embodiment of FIG. 17.

Difference from the embodiment of FIG. 17 lies in that the spiral conductors 41 and 42 are replaced with meandering conductors 45, 46. As compared to the embodiment of FIG. 17, when the antenna in which the invention is embodied is applied to an ultra-high frequency range of a GHz band and above, this embodiment yields an effect that the antenna efficiency is enhanced, similar to the effect of the embodiment of FIG. 18 in comparison to the embodiment of FIG. 16.

Figure 20:
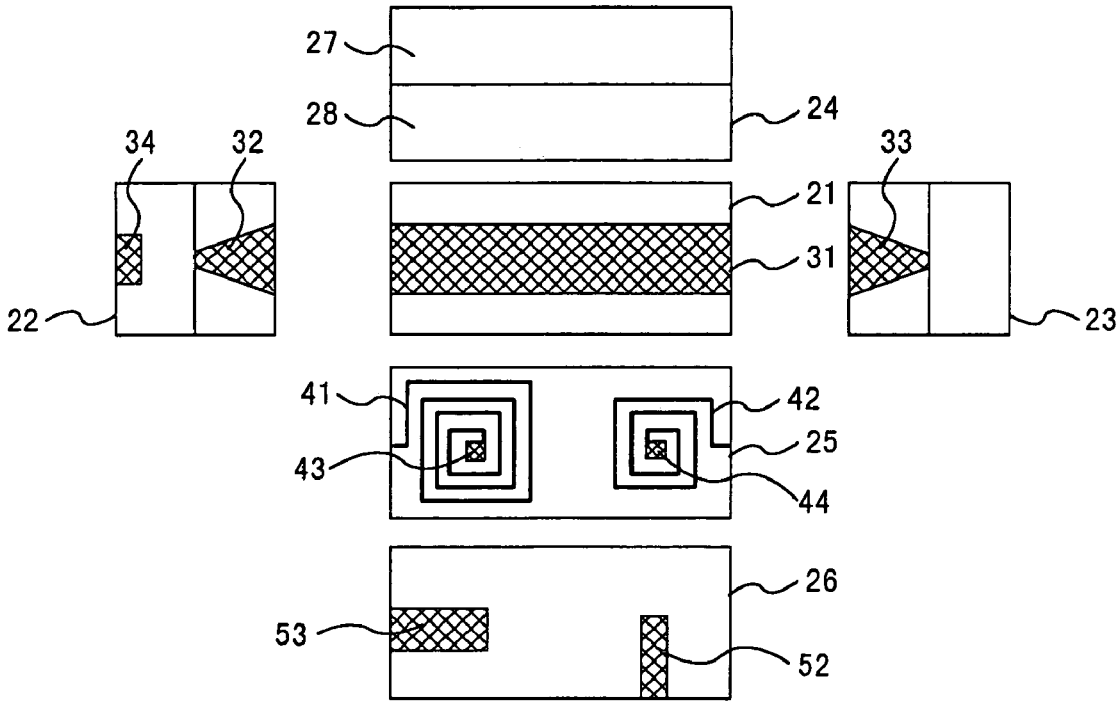
FIG. 20 is a development view to explain another multi-mode antenna embodiment of the present invention.

Another embodiment of the present invention is described with FIG. 20. FIG. 20 is a diagram showing a small multi-mode antenna structure in which the invention is embodied in relation to its multilayer substrate fabrication method, wherein the antenna structure is made up of the top layer 21 which forms the top surface, left side surface 22, right side surface 23, front surface 24, intermediate layer 25 between layers, and bottom layer 26 which forms the bottom surface, as is the case for the embodiment of FIG. 16.

Difference from the embodiment of FIG. 16 lies in that the feeding conductor 34 is not electrically joined to the radiating conductor left side pattern 32, the first strip ground conductor 51 is replaced with a strip conductor 53, and the feeding conductor 34 is electrically joined to the first strip conductor 53. In the structure of this embodiment, by setting up the feeding point anywhere in the feeding conductor 34 and connecting the second strip ground conductor 52 to the ground potential of the RF circuit, the structure of the embodiment of the FIG. 4 can be realized. Therefore, according to this embodiment, the multi-mode antenna in which the invention is embodied can be fabricated by multilayer process and, consequently, downsizing the multi-mode antenna and cost reduction by manufacturing economy of scale can be achieved.

Figure 21:
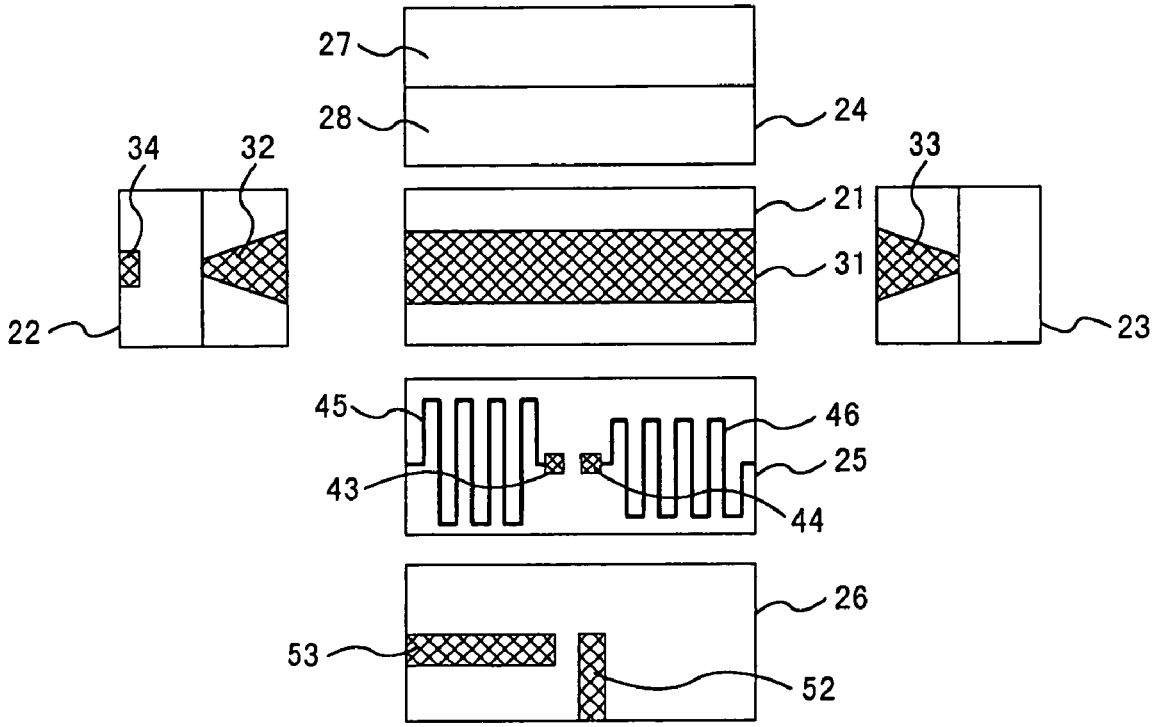
FIG. 21 is a development view to explain another multi-mode antenna embodiment of the present invention.

Another embodiment of the present invention is described with FIG. 21. FIG. 21 is a diagram showing a small multi-mode antenna structure in which the invention is embodied in relation to its multilayer substrate fabrication method, wherein the antenna structure is made up of the top layer 21 which forms the top surface, left side surface 22, right side surface 23, front surface 24, intermediate layer 25 between layers, and bottom layer 26 which forms the bottom surface, as is the case for the embodiment of FIG. 20.

Difference from the embodiment of FIG. 20 lies in that the spiral conductors 41 and 42 are replaced with meandering conductors 45, 46. As compared to the embodiment of FIG. 20, when the antenna in which the invention is embodied is applied to an ultra-high frequency range of a GHz band and above, this embodiment yields an effect that the antenna efficiency is enhanced, similar to the effect of the embodiment of FIG. 18 in comparison to the embodiment of FIG. 16.

Figure 22A:
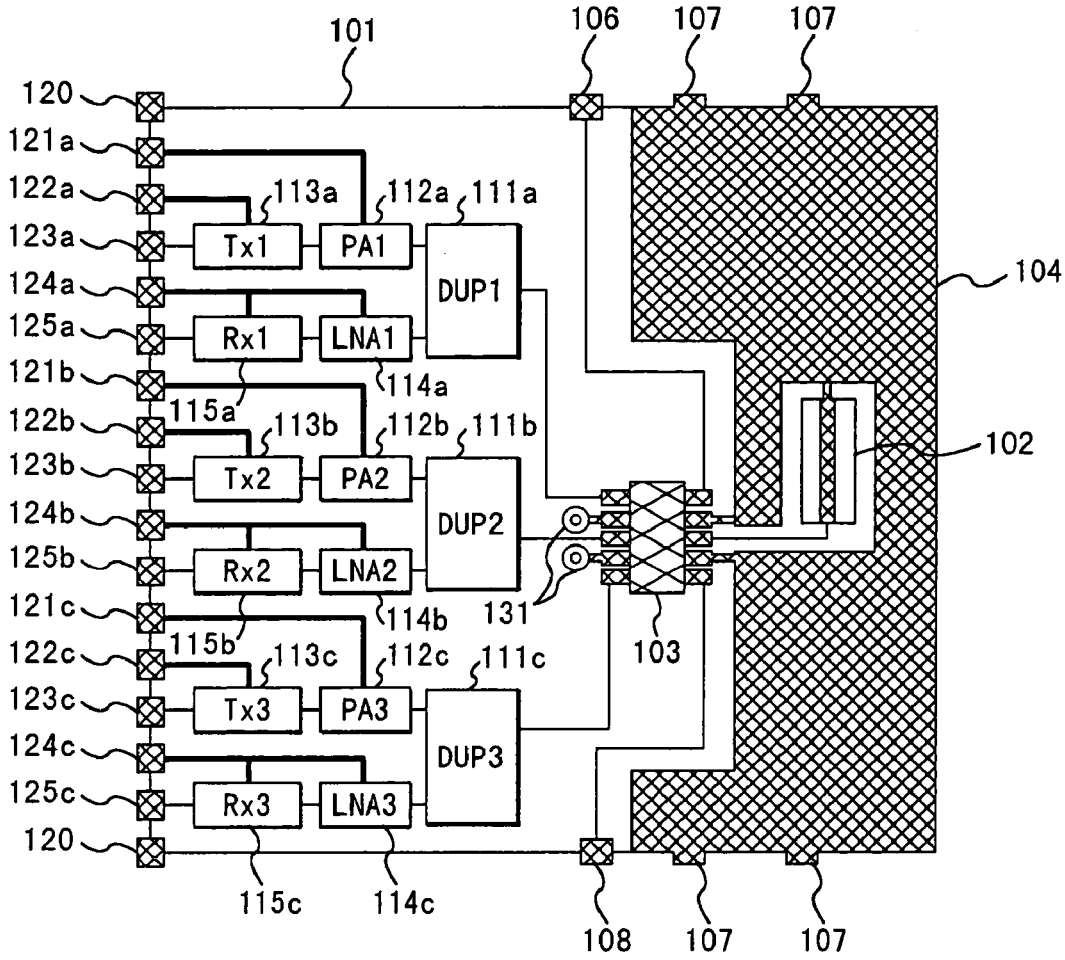
FIG. 22A is a top view to explain an embodiment of an RF module of the present invention.
Figure 22B:
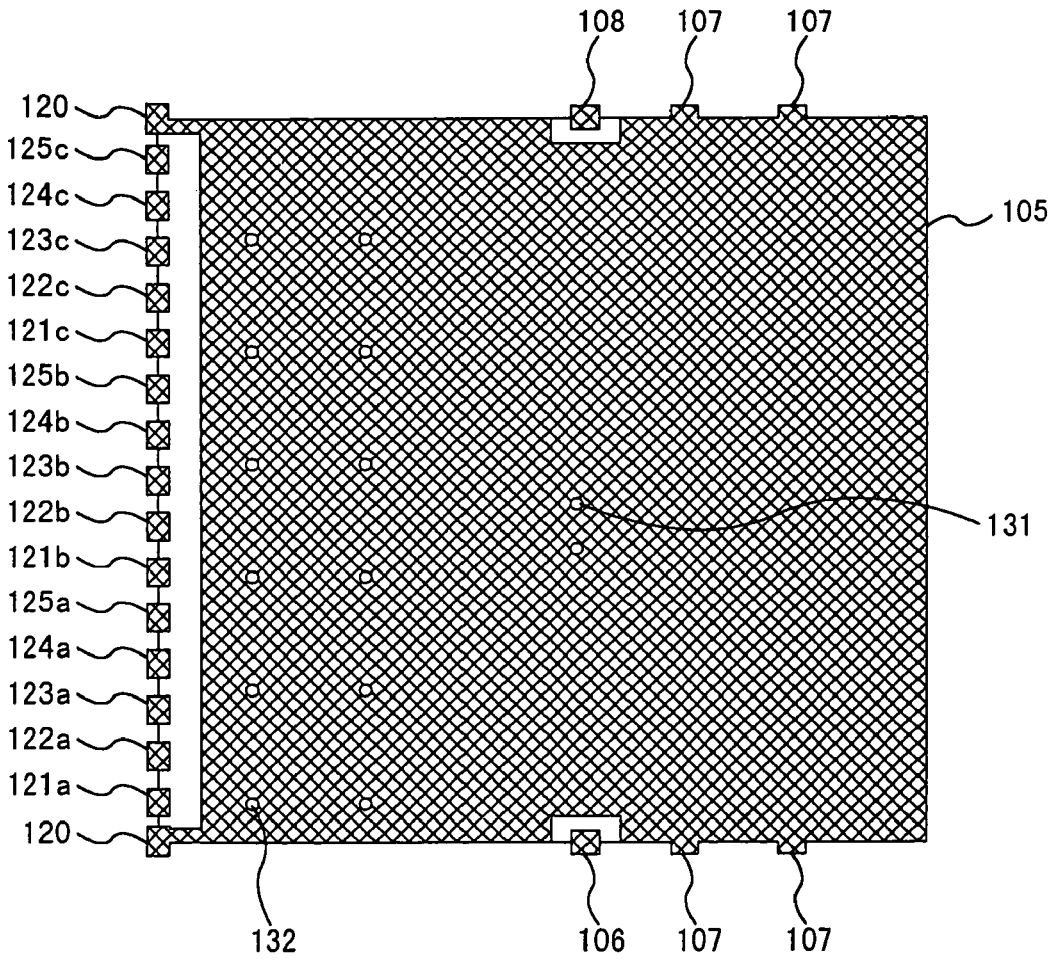
FIG. 22B is a bottom view of the RF module shown in FIG. 22A.

Another embodiment of the present invention is described with FIGS. 22A and 22B. FIGS. 22A and 22B are diagrams showing a structure of an RF module equipped with a multi-mode antenna, wherein the invention is embodied; these diagrams are, respectively, a top view and a bottom view of the RF module.

On the front surface of an RF substrate 101 consisting of a single layer or multiple layers, a small multi-mode antenna 102 of the present invention and a RF multi-contact switch 103 are placed on the same plane.

A transmit circuit (Tx) 113*a* (113*b*, 113*c*) and a power amplifier (PA) 112*a* (112*b*, 112*c*) are concatenated in order from a transmit signal input terminal 123*a* (123*b*, 123*c*). A receive circuit (Rx) 115*a* (115*b*, 115*c*) and a low noise amplifier (LNA) 114*a* (114*b*, 114*c*) are concatenated in order from a receive signal output terminal 125*a* (125*b*, 125*c*). A first branch output of the power amplifier 112*a* (112*b*, 112*c*) and a second branch output to the low noise amplifier (LNA) 114*a* (114*b*, 114*c*) are connected to a duplexer (DUP) 111*a* (111*b*, 111*c*).

A first ground conductor 104 which is formed in a plane conductor pattern is formed on the front surface of the RF substrate 101 and a second ground conductor 105 which is formed in a plane conductor pattern is formed on the reverse side.

On the circumferences of the RF substrate 101, first ground terminals 107, second ground terminals 120, power source terminals 121 for power amplifiers, power source terminals 122 for transmit circuits, transmit signal input terminals 123, power source terminals 124 for receivers, receive circuit output terminals 125, a power source terminal 106 for RF multi-contact switch, and an RF multi-contact switch control terminal 108 are disposed.

A ground terminal of the multi-mode antenna 102 is electrically connected to the first ground conductor 104 that encloses the multi-mode antenna. A feeding point of the multi-mode antenna 102 is connected to a common contact of the RF multi-contact switch 103 and individual contacts of the RF multi-contact switch 103 are connected to common branch inputs of the duplexers 111*a* (111*b*, 111*c*).

A ground terminal of the RF multi-contact switch 103 is electrically connected to the second ground conductor 105 via a through hole 131. Ground terminals of the power amplifiers 112*a* (112*b*, 112*c*), transmit circuits 113*a* (113*b*, 113*c*), low noise amplifiers 114*a* (114*b*, 114*c*), and receive circuits 115*a* (115*b*, 115*c*) are electrically connected to the second ground conductor 105 via through holes 132.

The first ground terminals 107 are connected to the first ground conductor 104 and the second ground conductor 105 and the second ground terminals 120 are connected to the second ground conductor 105.

The power source terminals 121 for power amplifiers are connected to the power source sections of the power amplifiers 112*a* (112*b*, 112*c*) by a suitable wiring conductor pattern and the power source terminals 122*a* (122*b*, 122*c*) for transmit circuits are connected to the power source sections of the transmit circuits 113*a* (113*b*, 113*c*) by a suitable wiring conductor pattern. The power source terminals 124*a* (124*b*, 124*c*) for receivers are connected to the power source sections of the receive circuits 115*a* (115*b*, 115*c*) and the low noise amplifiers 114*a* (114*b*, 114*c*) by a suitable wiring conductor pattern. The power source terminal 106 for RF multi-contact switch and the RF multi-contact switch control terminal 108 are, respectively, connected to the power source section and the control signal input section of the RF multi-contact switch 103 by a suitable wiring conductor pattern.

As for the units, namely, the duplexers 111, power amplifiers 112, transmit circuits 113, low noise amplifiers 114, and receive circuits 115, and as for the terminals, namely, the power source terminals 121 for power amplifiers, power source terminals 122 for transmit circuits, transmit signal input terminals 123, power source terminals 124 for receivers, and receive circuit output terminals 125, a plurality of these units and terminals as many as the number of carrier frequencies are mounted on the RF substrate 101, wherein the carrier frequencies are used by a wireless system to provide information transmission services to be handled by the RF module equipped with the multi-mode antenna of this embodiment. In this embodiment, the wireless system are assumed to use three carrier frequencies and these units and terminals in sets of three (a, b, c) are mounted.

This RF module structure is a variant of the module that applies for a case where the system providing information transfer by wireless communication uses a FDD (Frequency Division Multiple Access) system. For wireless apparatus capable of providing wireless information transmission services to the user, it is generally required to handle signals with a wide spectrum of frequencies from LF (low frequency) circuits that control man-machine interfaces to RF circuits that generate and radiate electromagnetic waves.

Especially, for RF circuits, a different form of realization from realizing LF circuits and IF (intermediate frequency) circuits is required, involving as short a wiring length as possible by using a costly substrate manufactured from high-priced substances with low loss properties and the use of a number of shielding layers for reducing electromagnetic interference from wiring patterns on the substrate, etc. in view of loss in terms of material constants, circuit performance deteriorated by stray components, and others. For this reason, a general manner is applied in which RF circuits are manufactured in modules and constructed separately from other LF and IF circuits and the RF modules are mounted on a circuit board on which the LF and IF circuits are also mounted.

In prior art, because an antenna capable of multi-mode operation at a single feeding point has not been found, it was needed to mount a plurality of costly RF modules on a circuit board where LF and IF circuits are also mounted and this was a major factor of increasing the cost of wiring apparatus equipped with the RF modules. A plurality of RF modules are scattered across the circuit board and this requires long wiring of RF signal lines and power source lines for power amplifiers, which caused a problem in which unwanted radiation of electromagnetic waves emitted by these lines deteriorates the performance of other circuits.

According to this embodiment, it becomes possible to integrate RF circuits that process multiple carriers into a singe RF module; this yields effects of reducing multimedia wireless apparatus manufacturing costs and improving the apparatus sensitivity.

Figure 23A:
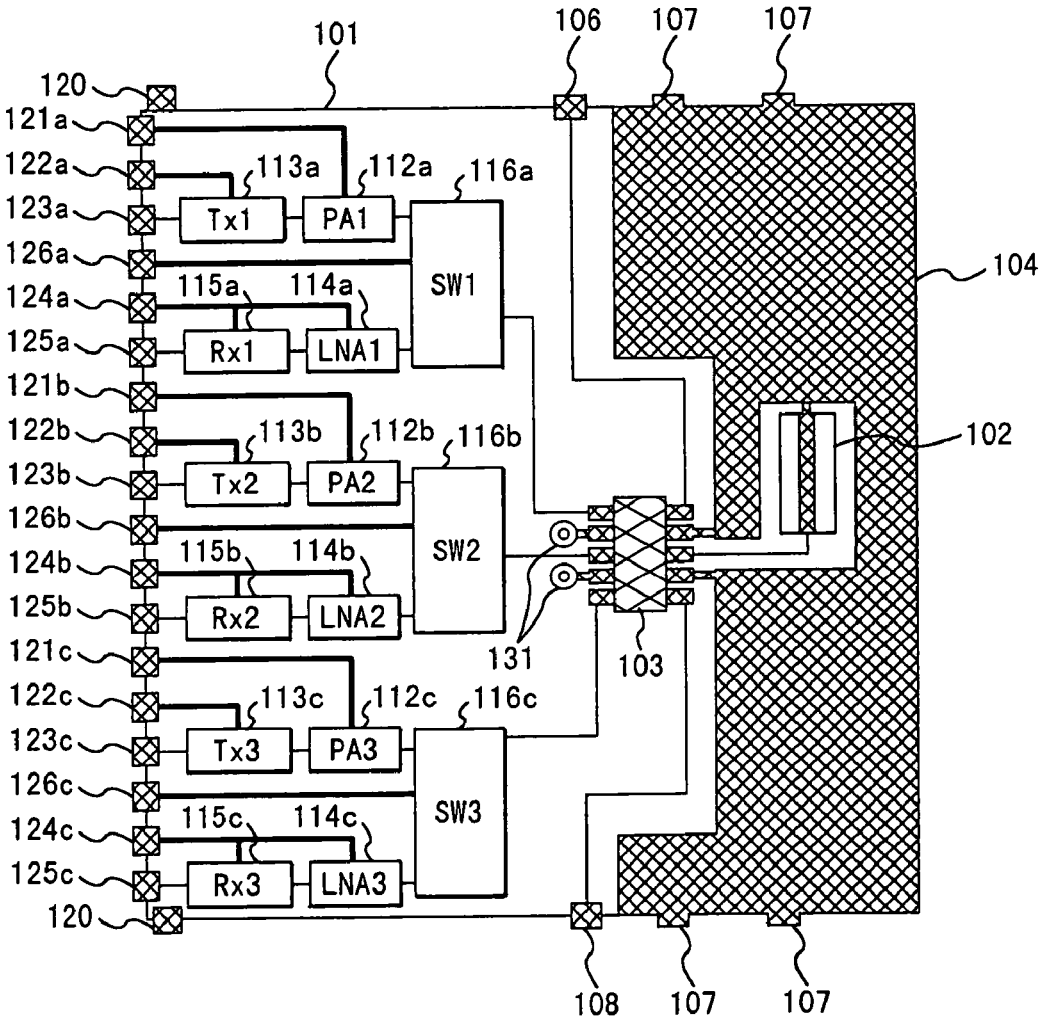
FIG. 23A is a top view to explain another RF module embodiment of the present invention.
Figure 23B:
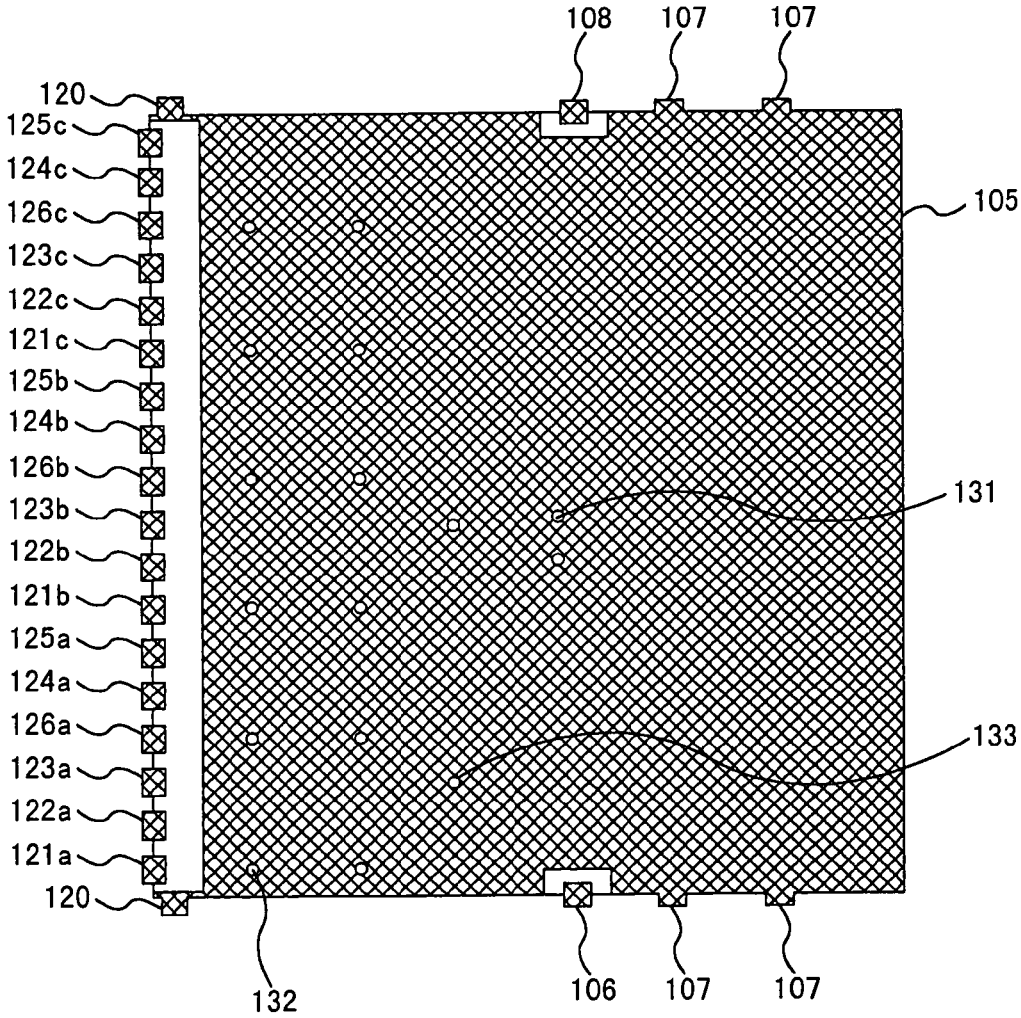
FIG. 23B is a bottom view of the RF module shown in FIG. 23A.

Another embodiment of the present invention is described with FIGS. 23A and 23B. FIGS. 23A and 23B are diagrams showing another structure of an RF module equipped with a multi-mode antenna, wherein the invention is embodied; these diagrams are, respectively, a top view and a bottom view of the RF module.

Difference from the embodiment of FIGS. 22A and 22B lies in that RF two-contact switches 116 are employed instead of the duplexers 111 and that new power source terminals 126 for RF two-contact switches are attached to the circumferences of the RF substrate 101 to supply power for the operation of the RF two-contact switches 116 and power is supplied from the power source terminals 126 for RF two-contact switches to the RF two-contact switches 116 by a suitable wiring conductor pattern and a through hole 133.

This RF module structure is a variant of the module that applies for a case where the system providing information transfer by wireless communication uses a TDD (Time Division Multiple Access) system. The effects of this embodiment are the same as those of the embodiment of FIGS. 22A and 22B.

In general, the specifications of filters for use in the circuitry of the RF two-contact switches enabling the TDD system can be more relaxed than those for the duplexers enabling the FDD system and, therefore, the former can be realized in smaller dimensions. Thus, this embodiment also yields effects of downsizing the RF module equipped with the multi-mode antenna, wherein the invention is embodied, and, moreover, downsizing the wireless apparatus using the module.

When the wireless apparatus supports a plurality of information service systems, some of which are FDD and other of which are TDD, it is self-evident that duplexers should be employed in circuit blocks for the former and the RF two-contact switches in circuit blocks for the latter from relation to the embodiment of FIGS. 22A and 22B.

Figure 24A:
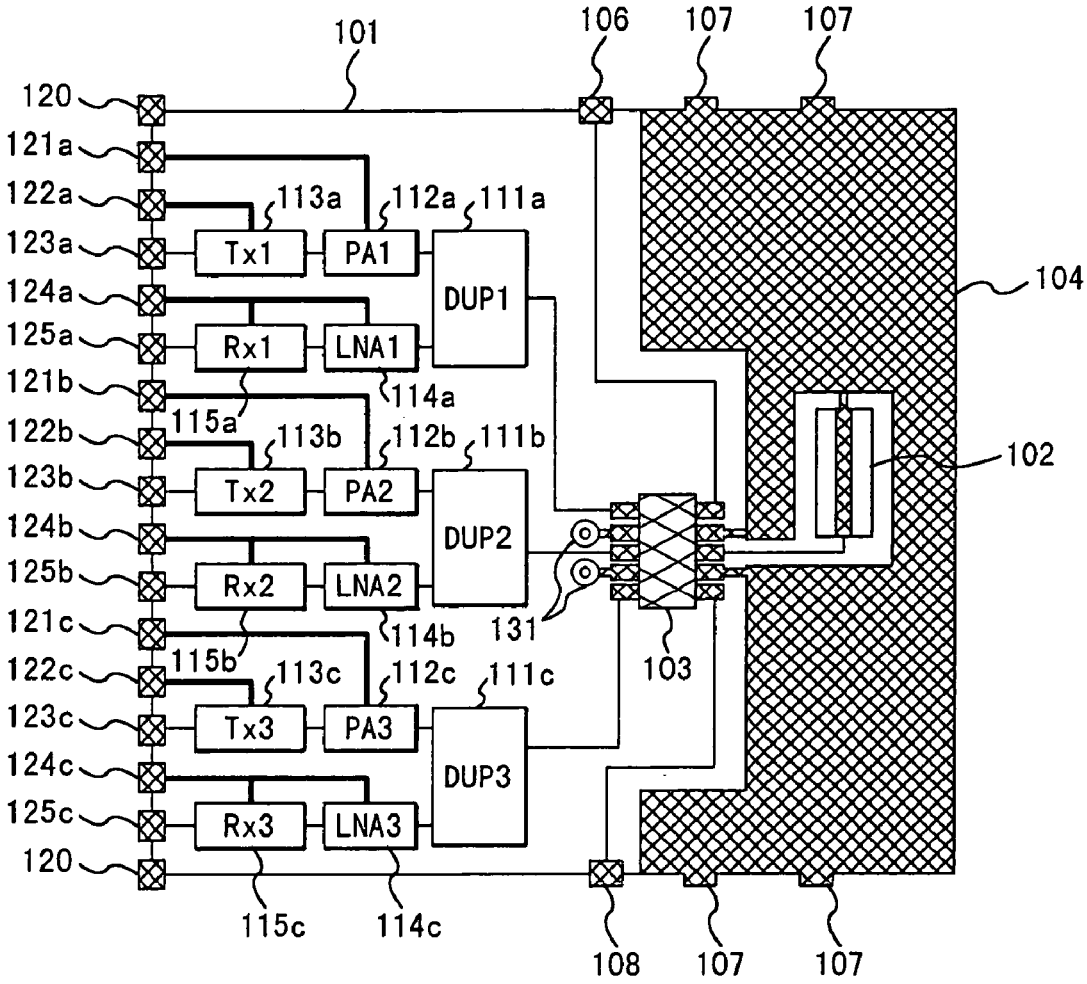
FIG. 24A is a top view to explain another RF module embodiment of the present invention.
Figure 24B:
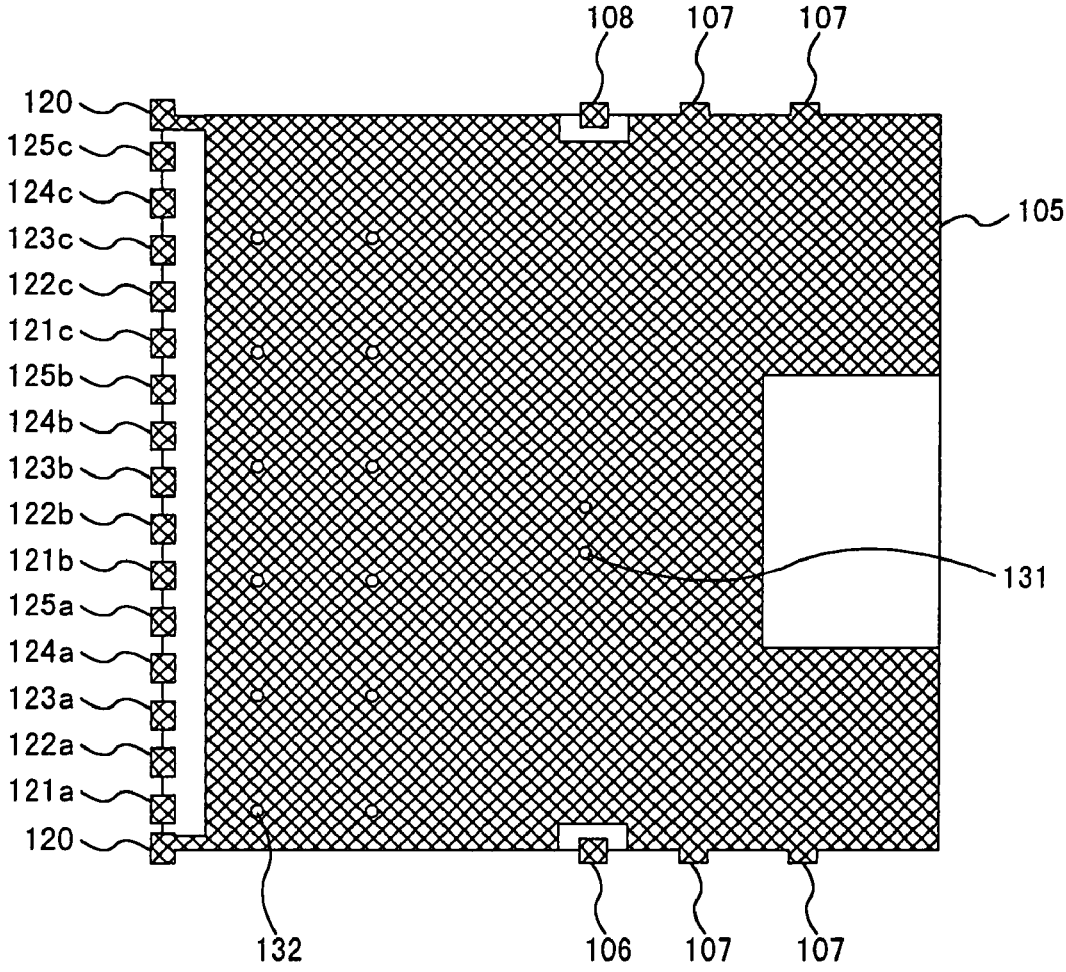
FIG. 24B is a bottom view of the RF module shown in FIG. 24A.

Another embodiment of the present invention is described with FIGS. 24A and 24B. FIGS. 22A and 22B are diagrams showing another structure of an RF module equipped with a multi-mode antenna, wherein the invention is embodied; these diagrams are, respectively, a top view and a bottom view of the RF module.

Difference from the embodiment of FIGS. 22A and 22B lies in that a portion of the second ground conductor 105, corresponding to the region where the multi-mode antenna 102 is mounted on the RF substrate 101, is removed.

The effects of this embodiment are the same as those of the embodiment of FIGS. 22A and 22B. In this embodiment, unless the multi-mode antenna 102 has one-sided directivity, the multi-mode antenna can radiate electromagnetic waves as well in the direction of the reverse side of the RF substrate 101. Thus, this embodiment yields an effect of enhancing the gain of the multi-mode antenna and, in consequence, an effect of enhancing the sensitivity of the wireless apparatus using the RF module equipped with the multi-mode antenna of this embodiment.

According to the present invention, because good impedance matching between the RF circuit and free space is achieved at the single feeding point for multiple frequencies, a multi-mode antenna suitable for multimedia wireless apparatus in an information system that provides a plurality of information transmission services by using carriers with multiple frequencies can be realized. Because RF circuits that process multiple carriers can be integrated into a single RF module, the invention yields the effects of reducing multimedia wireless apparatus manufacturing costs and improving the apparatus sensitivity.

INDUSTRIAL APPLICABILITY

As implied above, the present invention is suitable for being applied to multimedia wireless apparatus in an information system that provides a plurality of information transmission services by using carriers with multiple frequencies, such as, e.g., mobile wireless terminals such as multi-mode mobile phones and personal handy phones (PHS), wireless LAN terminals, or complex terminals having these multiple functions.

The invention claimed is:

1. A multi-mode antenna, comprising:

a radiating conductor which radiates electromagnetic waves with a plurality of frequencies;

a first one-port resonant circuit connected to one end of the radiating conductor;

a second one-port resonant circuit connected to the other end of the radiating conductor; and a single feeding point which is common for the plurality of frequencies and connected to the first one-port resonant circuit, wherein said first one-port resonant circuit is connected between one end of said radiating conductor and a ground potential point, said second one-port resonant circuit is connected between the other end of said radiating conductor and the ground potential point, and said feeding point is a connection point at which the first one-port resonant circuit and the one end of the radiation conductor are connected.

2. A multi-mode antenna, comprising:

a radiating conductor which radiates electromagnetic waves with a plurality of frequencies;

a first one-port resonant circuit connected to one end of the radiating conductor;

a second one-port resonant circuit connected to the other end of the radiating conductor; and a single feeding point which is common for the plurality of frequencies and connected to the first one-port resonant circuit, wherein said first one-port resonant circuit is connected between one end of said radiating conductor and said feeding point, and said second one-port resonant circuit is connected between the other end of said radiating conductor and a ground potential point.

3. A multi-mode antenna, comprising:

a radiating conductor which radiates electromagnetic waves with a plurality of frequencies;

a first one-port resonant circuit connected to one end of the radiating conductor;

a second one-port resonant circuit connected to the other end of the radiating conductor;

a single feeding point which is common for the plurality of frequencies and connected to the first one-port resonant circuit; and a third one-port resonant circuit connected between one end of said radiating conductor and a ground potential point, wherein said first one-port resonant circuit is connected between one end of said radiating conductor and said feeding point, and said second one-port resonant circuit is connected between the other end of said radiating conductor and the ground potential point.

4. The multi-mode antenna according to claim 3, wherein the sum of the number of poles and the number of zeros in equivalent circuit representations of said first one-port resonant circuit and said third one-port resonant circuit connected to said one end of said radiating conductor is equal to the number of said plurality of frequencies.

5. A multi-mode antenna, comprising:

a radiating conductor which radiates electromagnetic waves with a plurality of frequencies;

a first one-port resonant circuit connected to one end of the radiating conductor;

a second one-port resonant circuit connected to the other end of the radiating conductor; and a single feeding point which is common for the plurality of frequencies and connected to the first one-port resonant circuit, wherein an imaginary part of admittance or impedance in view from said one end of said radiating conductor toward the radiating conductor has a value which alternates between positive and negative signs with frequency increase in said plurality of frequencies.

6. A multi-mode antenna, comprising:

a radiating conductor which radiates electromagnetic waves with a plurality of frequencies;

a first one-port resonant circuit connected to one end of the radiating conductor;

a second one-port resonant circuit connected to the other end of the radiating conductor; and a single feeding point which is common for the plurality of frequencies and connected to the first one-port resonant circuit, wherein said radiating conductor is spatially divided into parts which are electrically connected by a one-port resonant circuit.

7. A multi-mode antenna, comprising:

a radiating conductor which radiates electromagnetic waves with a plurality of frequencies;

a first one-port resonant circuit connected to one end of the radiating conductor;

a second one-port resonant circuit connected to the other end of the radiating conductor; and a single feeding point which is common for the plurality of frequencies and connected to the first one-port resonant circuit, wherein the sum of the number of poles and the number of zeros in an equivalent circuit representation of the first one-port resonant circuit connected to said one end of said radiating conductor is equal to the number of said plurality of frequencies.

8. A multi-mode antenna comprising:

a radiating conductor which radiates electromagnetic waves with a plurality of frequencies, a first one-port resonant circuit connected to one end of the radiating conductor, a second one-port resonant circuit connected to the other end of the radiating conductor, a single feeding point which is common for the plurality of frequencies and connected to the first one-port resonant circuit, and a multilayer structure of a laminate of a plurality of substrates comprising top, intermediate and bottom layers, wherein a part of the radiating conductor is formed on the top layer, the first one-port resonant circuit and the second one-port resonant circuit are formed on the intermediate layer, the feeding point is formed on a side surface of the multilayer structure, and a ground conductor having ground potential is formed on the bottom layer.

9. The multi-mode antenna according to claim 8, wherein another intermediate layer is formed between said top layer and said intermediate layer and a shielding conductor to suppress electromagnetic coupling between said radiating conductor and said first one-port resonant circuit as well as said second one-port resonant circuit is formed on the another intermediate layer.

10. The multi-mode antenna according to claim 9, wherein said shielding conductor is electrically connected to the ground potential.

11. The multi-mode antenna according to claim 8, wherein said first one-port resonant circuit and said second one-port resonant circuit are formed as spiral conductors.

12. The multi-mode antenna according to claim 8, wherein said first one-port resonant circuit and said second one-port resonant circuit are formed as meandering conductors.

13. The multi-mode antenna according to claim 8, wherein said plurality of substrates are made of a radio frequency material selected from a group comprising dielectric substances and magnetic substances.

14. The multi-mode antenna according to claim 13, wherein, when said plurality of substrates are made of a dielectric substance, the plurality of substrates have different permittivity values each other and the permittivity of an upper-layer substrate is lower than that of a lower-layer substrate.

15. The multi-mode antenna according to claim 13, wherein, when said plurality of substrates are made of a magnetic substance, the plurality of substrates have different permeability values each other and the permeability of an upper-layer substrate is lower than that of a lower-layer substrate.

* * * * *

UNITED STATES PATENT AND TRADEMARK OFFICE

CERTIFICATE OF CORRECTION

PATENT NO. : 7,336,239 B2
APPLICATION NO. : 10/525378
DATED : February 26, 2008
INVENTOR(S) : Takei It is certified that error appears in the above-identified patent and that said Letters Patent is hereby corrected as shown below:

On the Title Page, Item (86) please delete:

"PCT/JP02/10608"

and insert:

--PCT/JP02/10680--

Signed and Sealed this

Tenth Day of June, 2008

JON W. DUDAS
*Director of the United States Patent and Trademark Office*